US008523168B2

(12) United States Patent
Samoto et al.

(10) Patent No.: US 8,523,168 B2
(45) Date of Patent: Sep. 3, 2013

(54) IMAGE RECORDING APPARATUS

(75) Inventors: Kenji Samoto, Nagoya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 289 days.

(21) Appl. No.: 13/073,937

(22) Filed: Mar. 28, 2011

(65) Prior Publication Data

US 2011/0310174 A1 Dec. 22, 2011

(30) Foreign Application Priority Data

Jun. 17, 2010 (JP) ..... 2010-138801

(51) Int. Cl.
*B65H 3/44* (2006.01)

(52) U.S. Cl.
USPC ..... 271/9.01; 271/9.11; 271/10.04

(58) Field of Classification Search
USPC ..... 271/9.01, 9.11, 9.12, 9.13, 10.04, 271/4.04
See application file for complete search history.

(56) References Cited

U.S. PATENT DOCUMENTS

| | | | |
|---|---|---|---|
| 7,451,975 | B2 | 11/2008 | Cook et al. |
| 2008/0157460 | A1 | 7/2008 | Izuchi et al. |
| 2009/0243186 | A1 | 10/2009 | Samoto |
| 2010/0045724 | A1 | 2/2010 | Toki |

FOREIGN PATENT DOCUMENTS

| | | | |
|---|---|---|---|
| CN | 101357546 | A | 2/2009 |
| JP | H08-169125 | A | 7/1996 |
| JP | 2002-249248 | A | 9/2002 |
| JP | 2007-090800 | A | 4/2007 |
| JP | 2008-162736 | A | 7/2008 |
| JP | 2009-242100 | A | 10/2009 |
| JP | 2010-047382 | A | 3/2010 |

OTHER PUBLICATIONS

Japan Patent Office, Notice of Reasons for Rejection for Japanese Patent Application No. 2010-138801 (counterpart to above-captioned patent application), mailed May 1, 2012.

State Intellectual Property Office of the People's Republic of China, Notification of First Office Action for Chinese Patent Application No. 201110078851.4 (counterpart to above-captioned patent application), mailed Jun. 8, 2013.

*Primary Examiner* — Michael McCullough
(74) *Attorney, Agent, or Firm* — Baker Botts L.L.P.

(57) ABSTRACT

There is provided an image recording apparatus including: a first and a second feeding roller; a recording head; a carriage; a first and a second drive motor; and a drive transmission switching mechanism transmitting a driving force of the second drive motor to the first and the second feeding roller. The drive transmission switching mechanism includes: a first to a fourth gear; a supporting shaft; a first transmitting section transmitting a rotation of the third gear to the first feeding roller and preventing transmission of rotation of the third gear to the first feeding roller, when the second gear is in a first posture; and a second transmitting section transmitting a rotation of the fourth gear to the second feeding roller and preventing transmission of rotation of the fourth gear to the second feeding roller, when the second gear is in the first posture.

9 Claims, 16 Drawing Sheets

IMAGE RECORDING APPARATUS

CROSS REFERENCE TO RELATED APPLICATION

The present application claims priority from Japanese Patent Application No. 2010-138801, filed on Jun. 17, 2010, the disclosure of which is incorporated herein by reference in its entirety.

BACKGROUND OF THE INVENTION

1. Field of the Invention

The present invention relates to an image recording apparatus capable of feeding a recording medium from each of two mounting portions with the use of two feeding rollers.

2. Description of the Related Art

Conventionally, there has been provided an image recording apparatus using an ink jet recording method, including: a first mounting portion and a second mounting portion each on which a sheet-type recording medium such as a recording paper can be mounted; a first feeding roller feeding the recording medium from the first mounting portion to a transporting route; a second feeding roller feeding the recording medium from the second mounting portion to the transporting route; a main transporting roller pair nipping and transporting the fed recording medium; and a recording head jetting ink onto the recording medium transported by the main transporting roller pair. This type of image recording apparatus is used as, for example, a printer, a copying machine, and a multi-function machine having printing, scanning, copying and faxing functions and the like.

An image recording apparatus that drives a first feeding roller and a second feeding roller using one drive motor is known. This image recording apparatus includes a drive transmission switching mechanism. The drive transmission switching mechanism includes: a drive gear driven by a drive motor; a switching gear whose posture is changed to a first posture and a second posture, and engaging with the drive gear in either posture; a first receiving gear engaging with the switching gear in the first posture; a second receiving gear engaging with the switching gear in the second posture; a first transmitting section transmitting a torque or a rotative force of the first receiving gear to the first feeding roller; and a second transmitting section transmitting a torque or a rotative force of the second receiving gear to the second feeding roller. The switching gear can move in a direction along a rotation axis of the drive gear, and when the switching gear is moved, a posture thereof is changed to the first and the second posture.

SUMMARY OF THE INVENTION

However, the aforementioned drive transmission switching mechanism involves a problem such that the gear may be wrongly switched, and when the feeding roller is driven by switching a drive transmission path, erroneous paper feeding may occur due to the wrong gear switching.

The present invention has an object to provide a structure with which an occurrence of erroneous paper feeding due to wrong gear switching can be prevented, in an image recording apparatus capable of driving two feeding rollers using one drive motor with the use of a drive transmission switching mechanism.

According to an aspect of the present invention, there is provided an image recording apparatus which jets an ink to record an image on a sheet-type recording medium, including:

a first mounting portion and a second mounting portion each on which the recording medium are mounted;

a first feeding roller which feeds the recording medium mounted on the first mounting portion;

a second feeding roller which feeds the recording medium mounted on the second mounting portion;

a recording head which jets the ink onto the recording medium fed by one of the first feeding roller and the second feeding roller;

a carriage which holds the recording head to move in a direction orthogonal to a transporting direction of the recording medium;

a first drive motor which reciprocates the carriage;

a second drive motor which rotates in a normal direction and a reverse direction; and a drive transmission switching mechanism which transmits a driving force of the second drive motor to the first feeding roller and the second feeding roller, the drive transmission switching mechanism includes:

- a first gear of which a rotation axis is directed in a moving direction of the carriage and which is rotated by the second drive motor;
- a supporting shaft of which axial direction is directed in the moving direction;
- a second gear through which the supporting shaft is inserted, which is moved in the moving direction by the carriage, which changes its posture to a first posture and a second posture while being moved in the moving direction, and which engages with the first gear in the first and second postures;
- a third gear of which rotation axis is directed in the moving direction and which engages with the second gear in the first posture;
- a fourth gear of which rotation axis is directed in the moving direction and which engages with the second gear in the second posture;
- a first transmitting section which transmits a rotation of the third gear rotated by the second drive motor rotating in the normal direction to the first feeding roller to rotate the roller in a direction in which the recording medium is fed; and which prevents transmission of rotation of the third gear rotated by the second drive motor rotating in the reverse direction to the first feeding roller, under a condition that the second gear is in the first posture; and
- a second transmitting section which transmits a rotation of the fourth gear rotated by the second drive motor rotating in the reverse direction to the second feeding roller to rotate the roller in the direction in which the recording medium is fed; and which prevents transmission of rotation of the fourth gear rotated by the second drive motor rotating in the normal direction to the second feeding roller, under a condition that the second gear is in the second posture.

In the image recording apparatus of the present invention, it is possible to reduce the number of drive motors to be used with the use of the drive transmission switching mechanism. Further, since the first feeding roller is rotated by the normal rotation of the second drive motor, and the second feeding roller is rotated by the reverse rotation of the second drive motor, even if wrong gear switching occurs, only the rollers are rotated, and there is no chance that the recording medium is erroneously fed from an unintended mounting portion. As a result of this, in the present invention, it is possible to reduce the number of drive motors, and besides, it becomes possible to prevent the occurrence of erroneous paper feeding caused by the wrong gear switching.

In the present invention, there is realized an image recording apparatus provided with a structure capable of reducing the number of drive motors to be used and preventing erroneous paper feeding caused by the wrong gear switching.

BRIEF DESCRIPTION OF THE DRAWINGS

FIGS. 3A and 3B are views of a maintenance mechanism, in which FIG. 3A is a plan view and FIG. 3B is a sectional view taken along a line IIIB-IIIB in FIG. 3A;

DETAILED DESCRIPTION OF THE PREFERRED EMBODIMENTS

Figure 1:
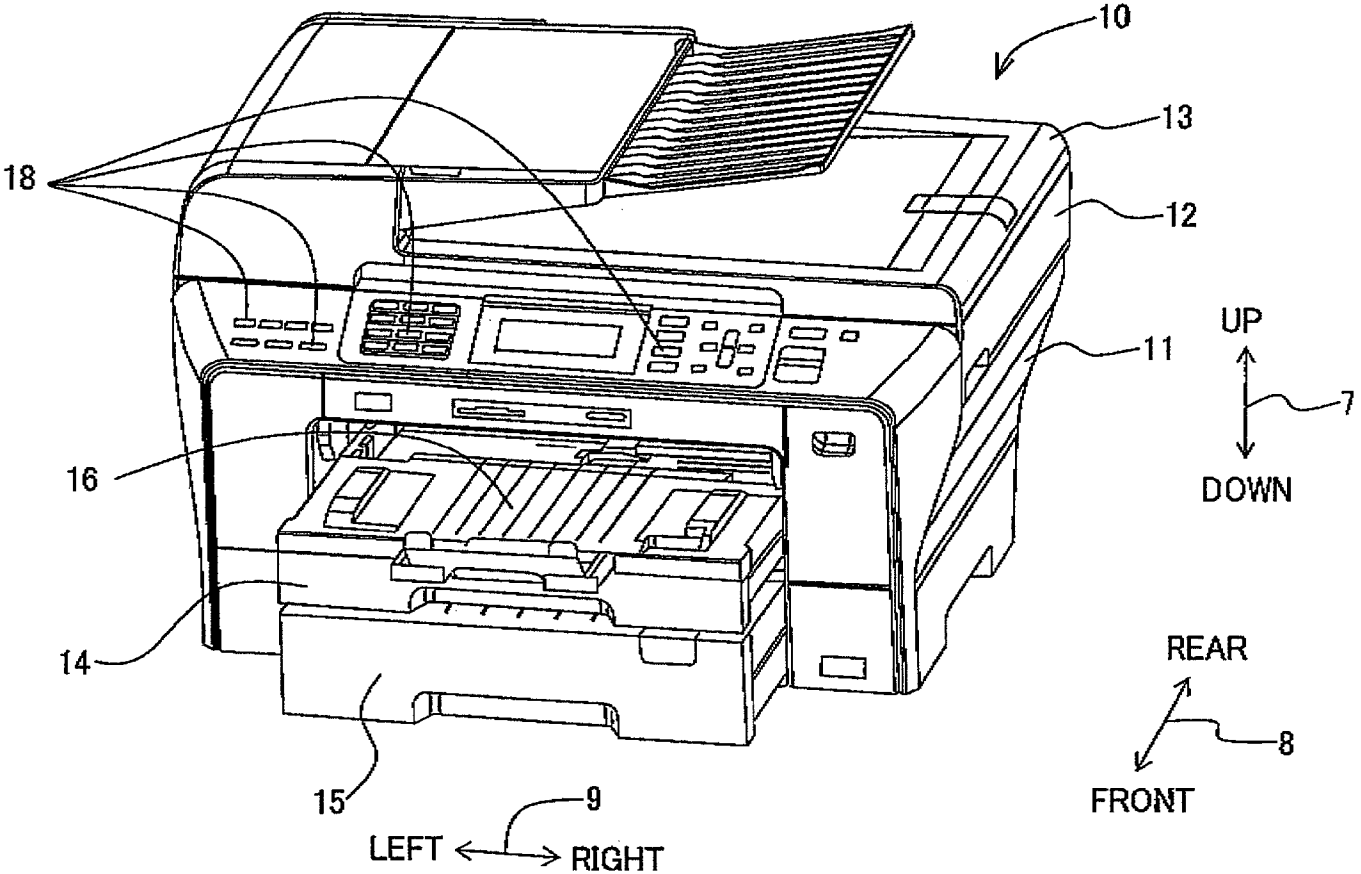
FIG. 1 is a perspective view of a multifunction machine.

Hereinafter, as an image recording apparatus in the present teaching, a multifunction machine 10 as shown in FIG. 1 having printing, scanning, copying and faxing functions and the like will be explained. The multifunction machine 10 is formed almost in a rectangular parallelepiped shape. In the description hereinbelow, a height direction, a depth direction, and a width direction of the multifunction machine 10 are defined as an up-down direction 7, a front-rear direction 8, and a left-right direction 9, respectively.

[Outline of Multifunction Machine 10]

The multifunction machine 10 includes: a printer housing 11; a scanner housing 12 being disposed above the printer housing 11 and housing a scanner unit; and an document cover 13 disposed above the scanner housing 12. An upper tray 14 and a lower tray 15 on which a paper 5 such as a plain paper, a glossy paper, a postcard or the like is mounted are accommodated in a lower portion of the printer housing 11 in a manner that the trays can be forwardly pulled out. A printer unit 17 in FIG. 2 that records an image on the paper 5 is accommodated in an upper portion of the printer housing 11. A paper discharge tray 16 is mounted on the upper tray 14. The upper tray 14 corresponds to a first mounting portion in the present teaching, the lower tray 15 corresponds to a second mounting portion in the present teaching, and the paper 5 corresponds to a recording medium in the present teaching.

Figure 11:
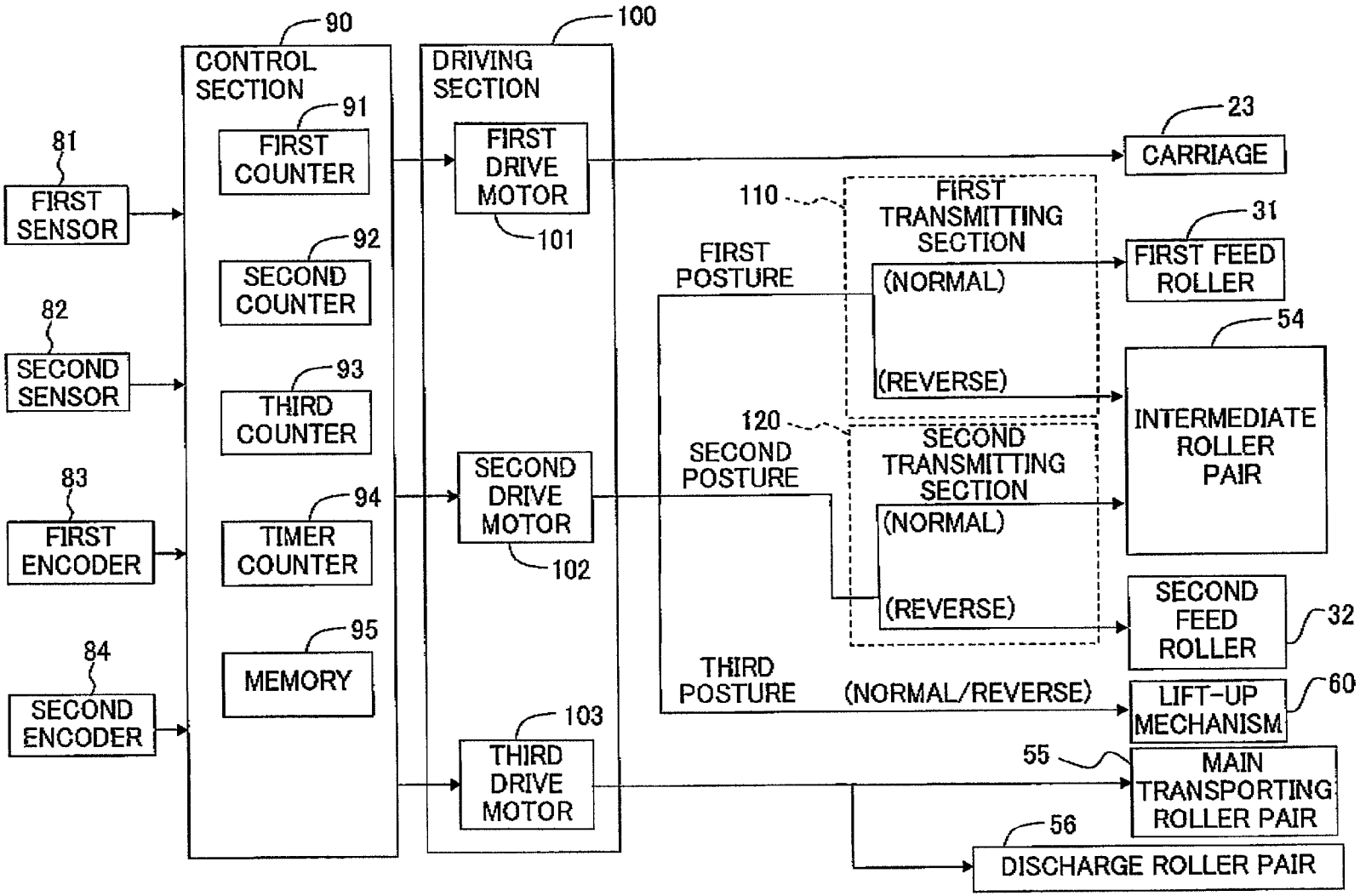
FIG. 11 is a block diagram of the present embodiment.

The scanner unit and the printer unit 17 are controlled by a control section 90 as shown in FIG. 11. The control section 90 is realized by, for example, various electronic components such as a microcomputer mounted on a substrate. The control section 90 performs capturing of images and recording of images based on a signal input through a plurality of input buttons 18 as shown in FIG. 1 or an external device such as a personal computer. The control section 90 corresponds to a control section in the present teaching.

[Printer Unit 17]

Figure 2:
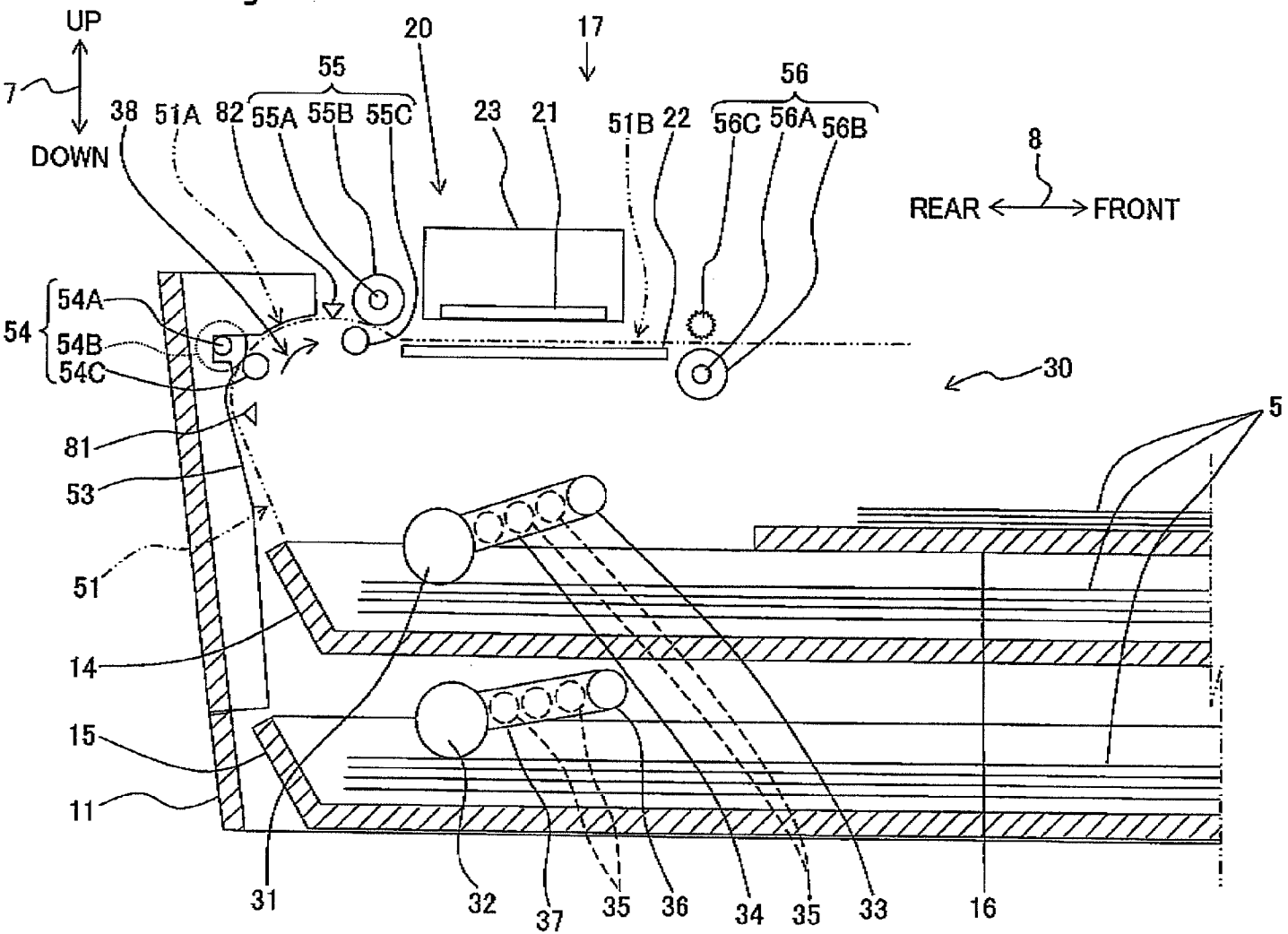
FIG. 2 is a schematic sectional view of a printer unit.

As shown in FIG. 2, the printer unit 17 includes: a transporting mechanism 30 transporting the paper 5 mounted on the upper tray 14 and the lower tray 15; a recording section 20 recording an image on the paper 5 transported by the transporting mechanism 30; a driving section 100 (refer to FIG. 11) and a drive transmission switching mechanism 40 (refer to FIG. 4); a later-described detecting mechanism including a first sensor 81 and the like; and a maintenance mechanism 60 (refer to FIG. 3) performing maintenance of the recording section 20.

[Recording Section 20]

As shown in FIG. 2, the recording section 20 includes: a plate-shaped platen 22 disposed above a rear portion of the upper tray 14; a recording head 21 disposed opposite to and above the platen 22; and a carriage 23 holding the recording head 21. The recording head 21 corresponds to a recording head in the present teaching, and the carriage 23 corresponds to a carriage in the present teaching.

A plurality of nozzles which are not shown in the drawings are formed on the recording head 21. A jetting port opening downward is formed on each of the nozzles. For instance, because of a deformation of a piezoelectric element, an ink droplet is jetted toward a side of the lower platen 22 from the jetting port. A power supply to the piezoelectric element is performed by using a flexible cable or the like, and is controlled by the control section 90 (refer to FIG. 11). The nozzle of the recording head 21 corresponds to a nozzle in the present teaching.

Figure 4:
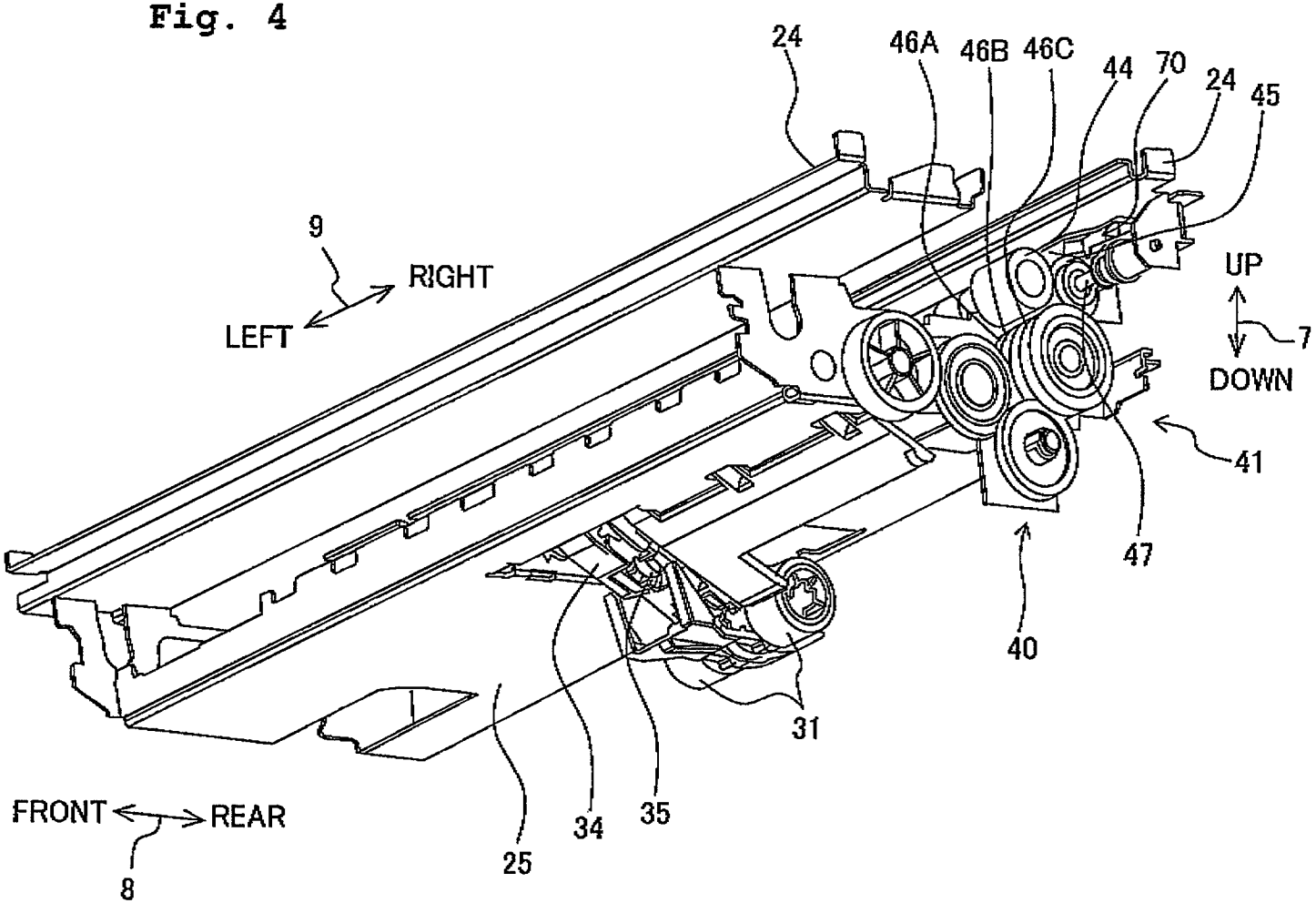
FIG. 4 is a perspective view of a drive transmission switching mechanism.

The carriage 23 is provided so that the carriage 23 straddles a pair of front and rear rail bodies 24 in FIG. 4 disposed above the platen 22, and is supported by the rail bodies 24 in a movable manner along the left-right direction 9. The rail bodies 24 are formed in a plate shape which are elongated in the left-right direction 9 and are supported by a frame 25. An abutting piece 26 (refer to FIG. 5) for performing gear switching in the drive transmission switching mechanism 40 is formed to be protruded in the right direction from a right end portion of the carriage 23.

[Maintenance Mechanism 60]

Figure 3A:
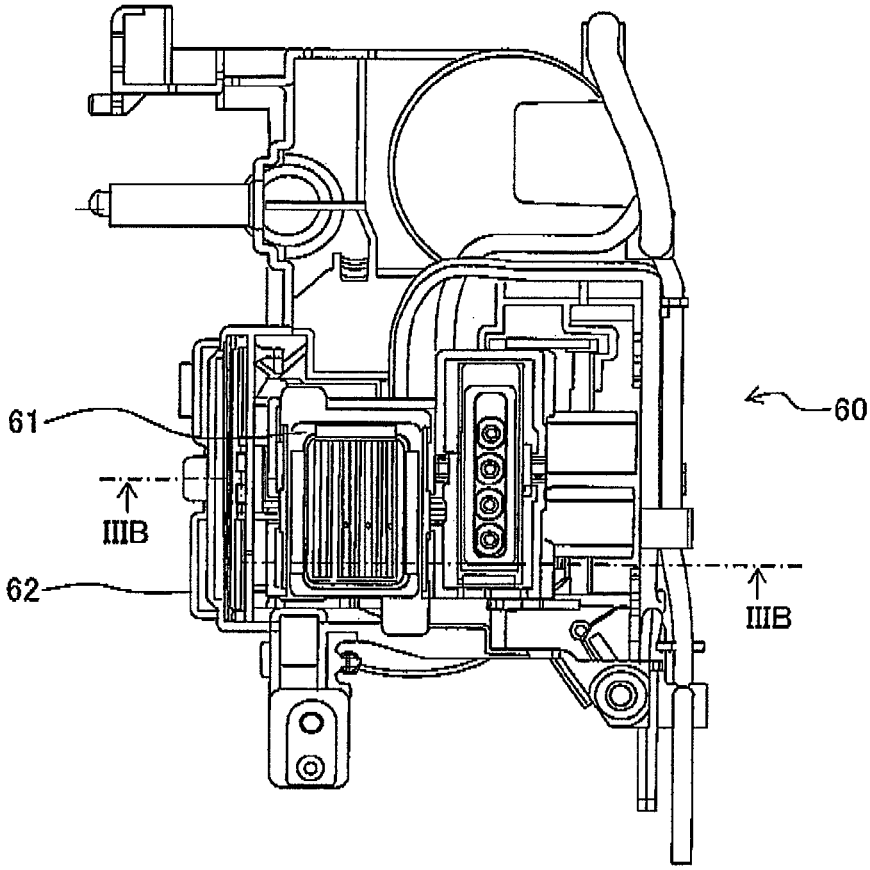
Figure 3B:
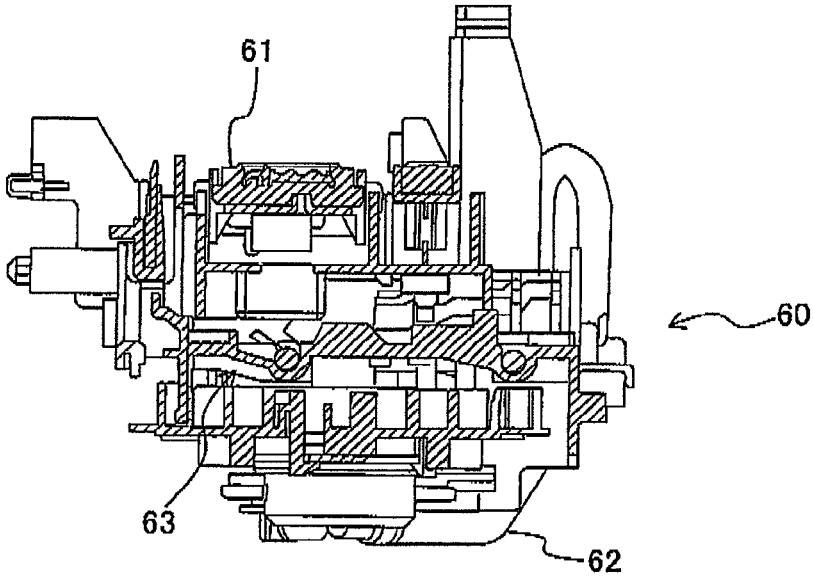

The maintenance mechanism 60 shown in FIG. 3 includes: a cap 61 capable of moving along the up-down direction 7 between an abutting position at which the cap covers the jetting ports of the nozzles of the recording head 21 and a separating position at which the cap is separated from the jetting ports; and a support 62 movably supporting the cap 61 between the abutting position and the separating position. Further, a lift-up mechanism 63 transmitting a driving force transmitted from the driving section 100 to the cap 61 with the use of the later-described drive transmission switching mechanism 40 to move the cap 61, is provided to the support 62. The maintenance mechanism 60 corresponds to a maintenance mechanism in the present teaching, the cap 61 corresponds to a cap in the present teaching, an abutting posture corresponds to a fourth posture in the present teaching, and a separating posture corresponds to a fifth posture in the present teaching.

[Transporting Mechanism 30]

The transporting mechanism 30 shown in FIG. 2 includes: a first feeding roller 31 feeding the paper 5 mounted on the upper tray 14; a second feeding roller 32 feeding the paper 5 mounted on the lower tray 15; a main transporting route 51 through which the papers 5 fed by the first feeding roller 31 and the second feeding roller 32 are transported; and an intermediate roller pair 54, a main transporting roller pair 55, and a paper discharge roller pair 56 being provided to the main transporting route 51 in an attached manner and nipping and transporting the papers 5.

[First Feeding Roller 31, Second Feeding Roller 32]

The first feeding roller 31 is disposed above a rear portion of the upper tray 14, and is supported by using a rotary shaft 33 and an arm 34 that are driven by the driving section 100. The first feeding roller 31 is rotatably attached to one end portion of the arm 34, and the other end portion of the arm 34 is rotatably supported by the rotary shaft 33. Further, the arm 34 is provided with a plurality of transmission gears 35 transmitting a rotation of the rotary shaft 33 to the first feeding roller 31.

When the arm 34 rotates around the rotary shaft 33, the first feeding roller 31 is brought into contact with the paper 5 mounted on the upper tray 14. A rotational force of the rotary shaft 33 is transmitted to the first feeding roller 31 via the transmission gears 35 to rotate the first feeding roller 31. Then, the first feeding roller 31 feeds the paper 5, with which the roller is brought into contact, in the upper direction from a rear wall of the upper tray 14. Similar to the first feeding roller 31, the second feeding roller 32 is supported by using a rotary shaft 36 and an arm 37, and when the second feeding roller 32 rotates, the paper 5 mounted on the lower tray 15 is fed. The first feeding roller 31 corresponds to a first feeding roller in the present teaching, and the second feeding roller 32 corresponds to a second feeding roller in the present teaching.

[Main Transporting Route 51]

The main transporting route 51 is formed of a guide member 53 and the platen 22, and is formed as a so-called U-turn pass including a curved portion 51A having an arc cross-section and a linear portion 51B having a linear cross-section. The main transporting route 51 passes between the platen 22 and the recording head 21. Because of the presence of the curved portion 51A, it is possible to dispose the recording section 20 above the upper tray 14, which allows the multi-function machine 10 to be compact in size. The main transporting route 51 is provided so that one end thereof is positioned above the rear wall of the upper tray 14 and the other end thereof is positioned above the paper discharge tray 16. The paper 5 fed from the upper tray 14 or the lower tray 15 is transported on the platen 22 in a forward direction and is discharged to the paper discharge tray 16.

[Intermediate Roller Pair 54]

The intermediate roller pair 54 includes a plurality of driving rollers 54B fixed to a rotary shaft 54A that is rotated by the driving section 100 and a driven roller 54C that is driven by the driving rollers 54B. The intermediate roller pair 54 is disposed so that an axial direction of the rotary shaft 54A is along the left-right direction 9 and that the curved portion 51A passes through a nip position of the roller pair. The intermediate roller pair 54 nips and transports the paper 5 fed from the upper tray 14 or the lower tray 15. The intermediate roller pair 54 corresponds to a roller pair in the present teaching.

[Main Transporting Roller Pair 55]

The main transporting roller pair 55 includes a plurality of driving rollers 55B fixed to a rotary shaft 55A that is rotated by the driving section 100 and a driven roller 55C that is driven by the driving rollers 55B. The main transporting roller pair 55 is disposed behind the platen 22 in which an axial direction of the rotary shaft 55A is along the left-right direction 9, and the main transporting roller pair 55 transports the paper 5 transported by the intermediate roller pair 54 in the forward direction.

[Paper Discharge Roller Pair 56]

The paper discharge roller pair 56 includes a plurality of driving rollers 56B fixed to a rotary shaft 56A that is rotated by the driving section 100 and a driven roller 56C that is driven by the driving rollers 56B. The paper discharge roller pair 56 is disposed ahead of the platen 22 in which an axial direction of the rotary shaft 56A is along the left-right direction 9, and the paper discharge roller pair 56 discharges the paper 5 transported by the main transporting roller pair 55 to the paper discharge tray 16.

[Driving Section 100]

The driving section 100 includes a first drive motor 101, a second drive motor 102 and a third drive motor 103 shown in FIG. 11 which are capable of rotating in either normal or reverse direction. As each of the drive motors 101, 102 and 103, a brushless DC motor is used, for example. The respective drive motors 101, 102 and 103 are driven by a drive circuit (not shown), and the driving thereof is controlled by the control section 90.

[First Drive Motor 101]

A driving force of the first drive motor 101 is transmitted to the carriage 23 by a first belt transmission mechanism (not shown), which moves the carriage 23 along the left-right direction 9. The first belt transmission mechanism includes, for example, an endless annular belt to which the carriage 23 is fixed. When the belt is rotated by the first drive motor 101, the carriage 23 moves in the left direction or the right direction. Regarding a rotational direction of the first drive motor 101, it is defined that the rotation of the first drive motor 101 is a normal or normal rotation when the carriage 23 is moved in the left direction, and the rotation of the first drive motor 101 is a reverse rotation when the carriage 23 is moved in the right direction. The first drive motor 101 corresponds to a first drive motor in the present teaching.

[Second Drive Motor 102]

A driving force of the second drive motor 102 is transmitted to the first feeding roller 31, the second feeding roller 32, the intermediate roller pair 54 and the cap 61 by the drive transmission switching mechanism 40. The second drive motor 102 corresponds to a second drive motor in the present teaching.

[Third Drive Motor 103]

The third drive motor 103 has a shaft coupled, directly or via a gear, to the rotary shaft 55A of the main transporting roller pair 55, and drives to rotate the rotary shaft 55A. A driving force of the third drive motor 103 is transmitted to the rotary shaft 56A by a second belt transmission mechanism (not shown). With the use of the third drive motor 103 and the second belt transmission mechanism, the main transporting roller pair 55 and the paper discharge roller pair 56 are simultaneously rotated in such a rotational direction in which the paper 5 is transported in a transporting direction 38. Regarding the direction of rotation of the third drive motor 103, it is defined that the paper 5 is transported in the transporting direction 38 when the third drive motor 103 is rotated in the normal direction.

[Drive Transmission Switching Mechanism 40]

The drive transmission switching mechanism 40 as shown in FIG. 4 includes: a gear switching mechanism 41; a first transmitting section 110 (refer to FIG. 12) transmitting a driving force switched by the gear switching mechanism 41 to the first feeding roller 31 or the intermediate roller pair 54; and a second transmitting section 120 (refer to FIG. 13) transmitting a driving force switched by the gear switching mechanism 41 to the second feeding roller 32 or the intermediate roller pair 54. The drive transmission switching mechanism 40 is disposed on the right side of the platen 22. The chive transmission switching mechanism 40, the first transmitting section 110 and the second transmitting section 120 correspond to a drive transmission switching mechanism, a first transmitting section and a second transmitting section, respectively, in the present teaching.

[Gear Switching Mechanism 41]

The gear switching mechanism 41 includes: a drive gear 44 which rotates when a rotational force of the second drive motor 102 is transmitted thereto by a transmission gear 119 (refer to FIG. 12); a switching gear 45; a first receiving gear 46A, a second receiving gear 46B and a third receiving gear 46C each having teeth that are configured to engage with the switching gear 45; and a holding mechanism 70 (refer to FIG. 5) holding the switching gear 45.

[Drive Gear 44, Switching Gear 45]

A supporting shaft 47 is disposed substantially parallel to a rotation axis of the drive gear 44, and the supporting shaft 47 is inserted through the switching gear 45. The switching gear 45 is configured to rotate around an axis of the supporting shaft 47 and is configured to also move along an axial direction of the supporting shaft 47. The switching gear 45 is formed to have a width dimension smaller than a width dimension of the drive gear 44 in the left-right direction 9. By moving along the left-right direction 9 within a range of the width dimension of the drive gear 44, a posture of the switching gear 45 is changed to a first posture, a second posture and a third posture, and the gear engages with the drive gear 44 in any of the postures. Here, the first posture corresponds to a posture in which the switching gear 45 engages with a left end portion of the drive gear 44, and the third posture corresponds to a posture in which the switching gear 45 engages with a right end portion of the drive gear 44. When the switching gear 45 moves in the right direction, the posture is changed in the order of the first posture in FIG. 5, the second posture in FIG. 6A, and the third posture in FIG. 6B. The drive gear 44, the switching gear 45 and the supporting shaft 47 correspond to a first gear, a second gear and a supporting shaft, respectively, in the present teaching. Further, the first posture, the second posture and the third posture of the switching gear 45 correspond to a first posture, a second posture and a third posture, respectively, in the present teaching.

[Holding Mechanism 70]

Figure 5:
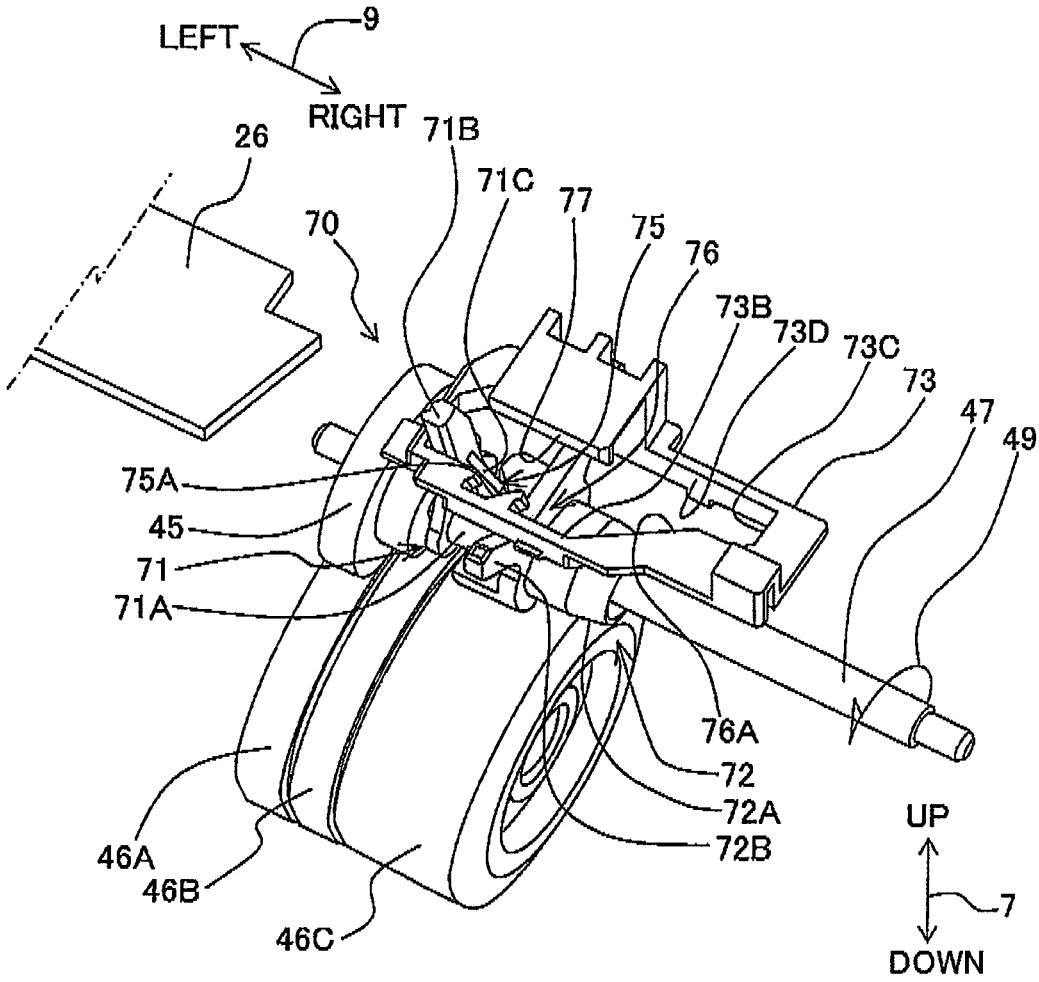
FIG. 5 is a perspective view of a gear switching mechanism in a first posture.
Figure 6A:
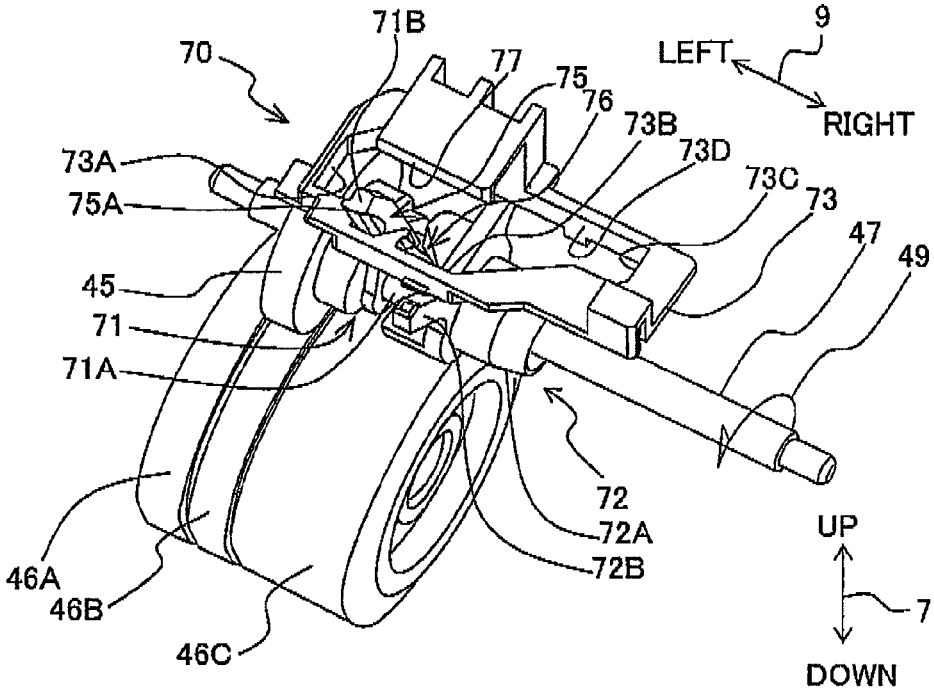
FIG. 6A is a perspective view of the gear switching mechanism in a second posture.
Figure 6B:
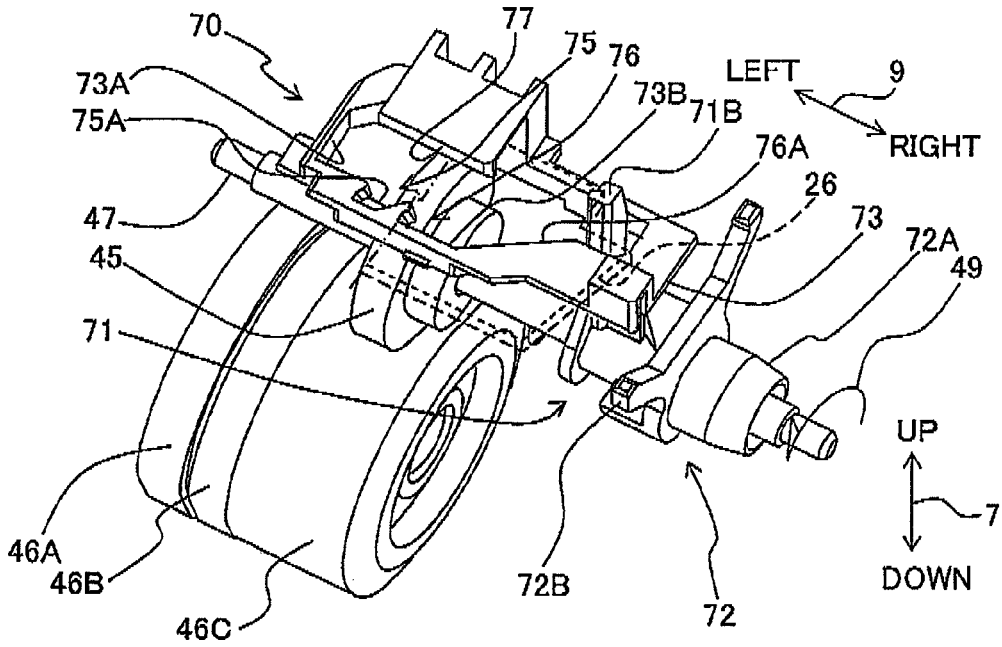
FIG. 6B is a perspective view of the gear switching mechanism in a third posture.

As shown in FIGS. 5 and 6, the holding mechanism 70 includes: a lever 71 and an abutting member 72 through which the supporting shaft 47 is inserted; a holding member 73 holding the lever 71; and first elastic member and second elastic member (not shown). The holding member 73 corresponds to a holding member in the present teaching.

Figure 7:
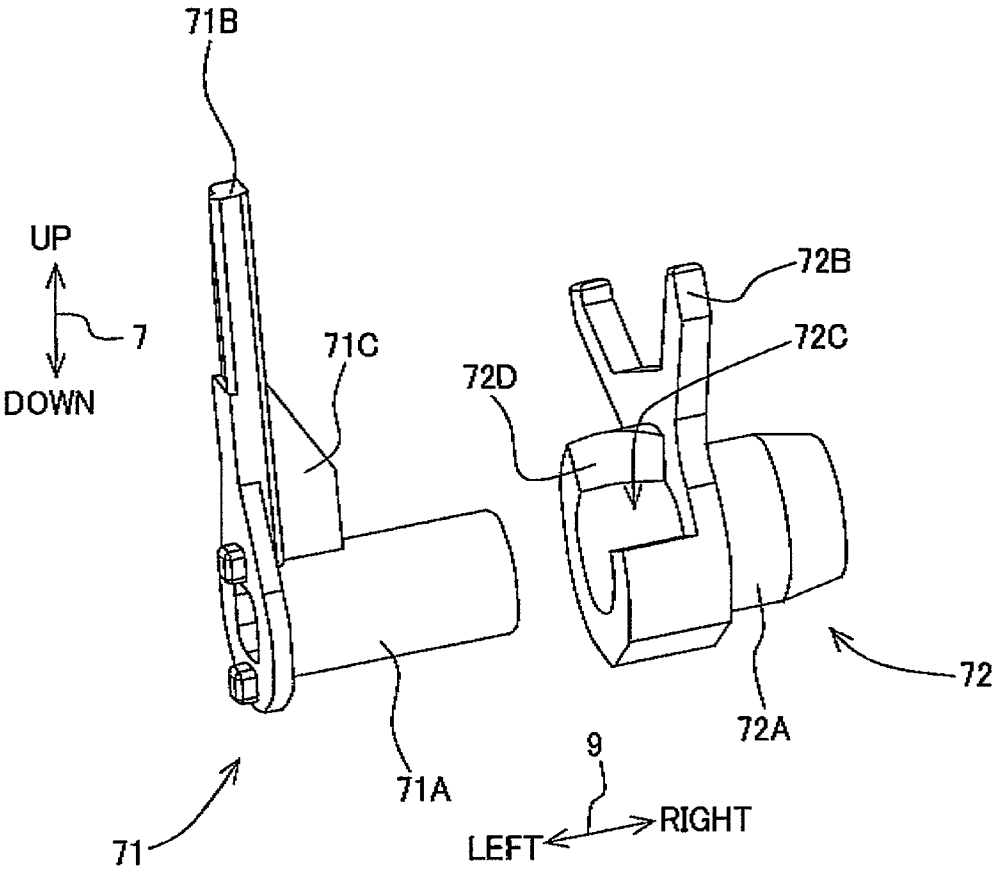
FIG. 7 is a perspective view of a lever member and an abutting member.

As shown in FIG. 7, the lever 71 includes: a column-shaped portion 71A through which the supporting shaft 47 is inserted; a lever projection 71B projecting or protruding in a radial direction (upward direction in the drawing) from a left end portion of a circumferential surface of the column-shaped portion 71A and on which the abutting piece 26 (refer to FIG. 5) that is provided to the aforementioned carriage 23 is abutted from the left side; and a rib 71C protruding in the right direction from a lower end portion of a right surface of the lever projection 71B. The lever 71 is configured to rotate around the axis of the supporting shaft 47 and is configured to also move along the axial direction of the supporting shaft 47. The rib 71C is formed in a shape having a small length (thickness) in a circumferential direction of the column-shaped portion 71A. The switching gear 45 biased in the right direction by the second elastic member (not shown) pushes the lever 71 from the left side. The lever 71 corresponds to a lever in the present teaching.

The abutting member 72 includes: a cylinder portion 72A through which the supporting shaft 47 is inserted; and a Y-shaped braking piece (break shoe) protruding in a radial direction (upward direction in the drawing) from a circumferential surface of the cylinder portion 72A and having a tip portion that is bifurcated. The abutting member 72 is configured to rotate around the axis of the supporting shaft 47 and is configured to move along the axial direction of the supporting shaft 47. On a left end portion of the cylinder portion 72A, there is formed a cutout portion 72C whose circumferential surface is formed as a spiral surface 72D. An axis of the spiral surface 72D coincides with an axis of the cylinder portion 72A, and a right end of the rib 71C of the lever 71 abuts on the spiral surface 72D. Therefore, when the abutting member 72 is strongly pushed against the lever 71, the lever member 71 rotates. The abutting member 72 is biased in the left direction by the first elastic member with a force larger than that of the aforementioned second elastic member. The switching gear 45, the abutting member 72 and the lever 71 push one another with the use of the first elastic member and the second elastic member, and can integrally move in the axial direction of the supporting shaft 47. As the first elastic member and the second elastic member, coil springs are used, for example. The first and the second elastic member corresponds to a first and a second elastic member, respectively, in the present teaching.

As shown in FIGS. 5 and 6, the holding member 73 is formed in a frame shape which is elongated in the axial direction of the supporting shaft 47 (left-right direction 9). The lever projection 71B of the lever 71 is inserted from below through the holding member 73, and the holding member 73 is fixed to a not-shown frame. A linear dimension of the holding member 73 in the left-right direction 9 is set to be larger than the width dimension of the drive gear 44, and besides, the lever projection 71B is formed sufficiently smaller than the holding member 73. The lever projection 71B is configured to move along an inner side of the frame-shaped holding member 73.

It is set such that a separation dimension between the two tip portions of the Y-shaped braking piece 72B of the abutting member 72 described above becomes larger than a width dimension of the holding member 73. The braking piece 72B clips the holding member 73 when the switching gear 45 is in the first posture and the second posture. When the braking piece 72B clips the holding member 73, a rotation of the abutting member 72 around the axis of the supporting shaft 47 is regulated or prohibited. When the switching gear 45 is in the third posture, the braking piece 72B releases the holding member 73. Accordingly, the abutting member 72 can rotate around the axis of the supporting shaft 47 in the third posture.

In a case where the abutting piece 26 provided to the carriage 23 does not abut on the lever projection 71B, the lever 71 is biased in the left direction by the biasing force of the aforementioned first elastic member. Accordingly, the lever projection 71B inserted through the holding member 73 is pushed against a left inner surface 73A of the holding member 73. At a position at which the lever projection 71B abuts on the left inner surface 73A, the switching gear 45 is in the first posture. The abutting member 72, which is pushed against the lever 71 by the biasing force of the aforementioned first elastic member, biases the lever member 71 with the use of the spiral surface 72D in a direction 49 that is one direction of the circumferential direction of the supporting shaft 47, thereby pushing the lever projection 71B against a front inner peripheral surface 73B of the holding member 73. A first cutout 75 and a second cutout 76 are provided to the front inner peripheral surface 73B. In the first posture, the lever projection 71B is pushed by the abutting piece 26 to be engaged with the first cutout 75. A posture in which the lever projection 71B is engaged with the first cutout 75 corresponds to the second posture. When the lever projection 71B engaged with the first cutout 75 is further pushed by the abutting piece 26, the lever 71 moves in the right direction while sliding a first inclined surface 75A provided to the first cutout 75, and is engaged with the second cutout 76. The lever projection 71B engaged with the second cutout 76 slides a second inclined surface 76A by being further pushed by the abutting piece 26, and moves to a position at which it abuts on a right inner surface 73C of the holding member 73. A posture in which the lever projection 71B abuts on the right inner surface 73C corresponds to the third posture.

The carriage 23 is provided in a manner that, at a position at which the lever projection 71B is pushed against the right inner surface 73C of the holding member 73, the jetting ports of the nozzles position above the cap 61 of the maintenance mechanism 60. Specifically, a right end of the rail bodies 24 is a standby position of the carriage 23, and when the carriage 23 is in the standby position, the switching gear 45 is in the third posture being a standby posture.

The holding member 73 includes a restricting piece 77 restricting a rotation of the lever projection 71B around the axis of the supporting shaft 47 when the carriage 23 in the standby position moves in the left direction. When the carriage 23 in the standby position moves in the left direction to separate from the lever projection 71B, the lever projection 71B is moved by the biasing force of the first elastic member and the restricting piece 77 in the left direction along a rear inner surface 73D of the holding member 73. Then, the lever projection 71B is released from the restricting piece 77 in the vicinity of the left inner surface 73A, and is moved to a position at which it abuts on the left inner surface 73A and the front inner surface 73B.

As described above, the holding mechanism 70 is structured so that the holding mechanism 70 holds the switching gear 45 in the first posture and the second posture changed from the first posture, and that the holding mechanism 70 does not hold the switching gear 45 in the third posture and the second posture changed from the third posture. Further, the holding mechanism 70 is structured to change the posture of the switching gear 45 to the first posture, the second posture and the third posture when it is pushed in the right direction by the aforementioned abutting piece 26 provided to the carriage 23. Note that the switching gear 45 is held in the third posture when the carriage 23 maintains the standby posture.

[First, Second and Third Receiving Gears 46A, 46B and 46C]

As shown in FIGS. 5 and 6, the first receiving gear 46A, the second receiving gear 4613 and the third receiving gear 46C are formed to have the mutually same diameter, and are disposed in a manner that rotation axes thereof lie on a straight line in the axial direction of the supporting shaft 47. Further, the first receiving gear 46A is disposed at a position at which the first receiving gear 46A engages with the switching gear 45 in the first posture, the second receiving gear 46B is disposed at a position at which the second receiving gear 46B engages with the switching gear 45 in the second posture, and the third receiving gear 46C is disposed at a position at which the third receiving gear 46C engages with the switching gear 45 in the third posture. The switching gear 45 is structured so that the switching gear 45 engages with any one of the first receiving gear 46A, the second receiving gear 46B and the third receiving gear 46C, and that the switching gear 45 selects any one of the first receiving gear 46A, the second receiving gear 46B and the third receiving gear 46C to rotate the selected gear.

The third receiving gear 46C transmits, directly or via a gear, a driving force to the lift-up mechanism 63 of the maintenance mechanism 60, and moves the cap 61 via the lift-up mechanism 63. Specifically, the multifunction machine 10 turns into a standby state in which the cap 61 covers the jetting ports of the nozzles and a printable state in which the cap 61 is detached from the nozzles, when the second drive motor 102 is normally rotated or reversely rotated in a state where the switching gear 45 is in the third posture. The first, second and third receiving gears 46A, 46B and 46C correspond to a third gear, a fourth gear and a fifth gear, respectively, in the present teaching.

[First Transmitting Section 110]

Figure 12:
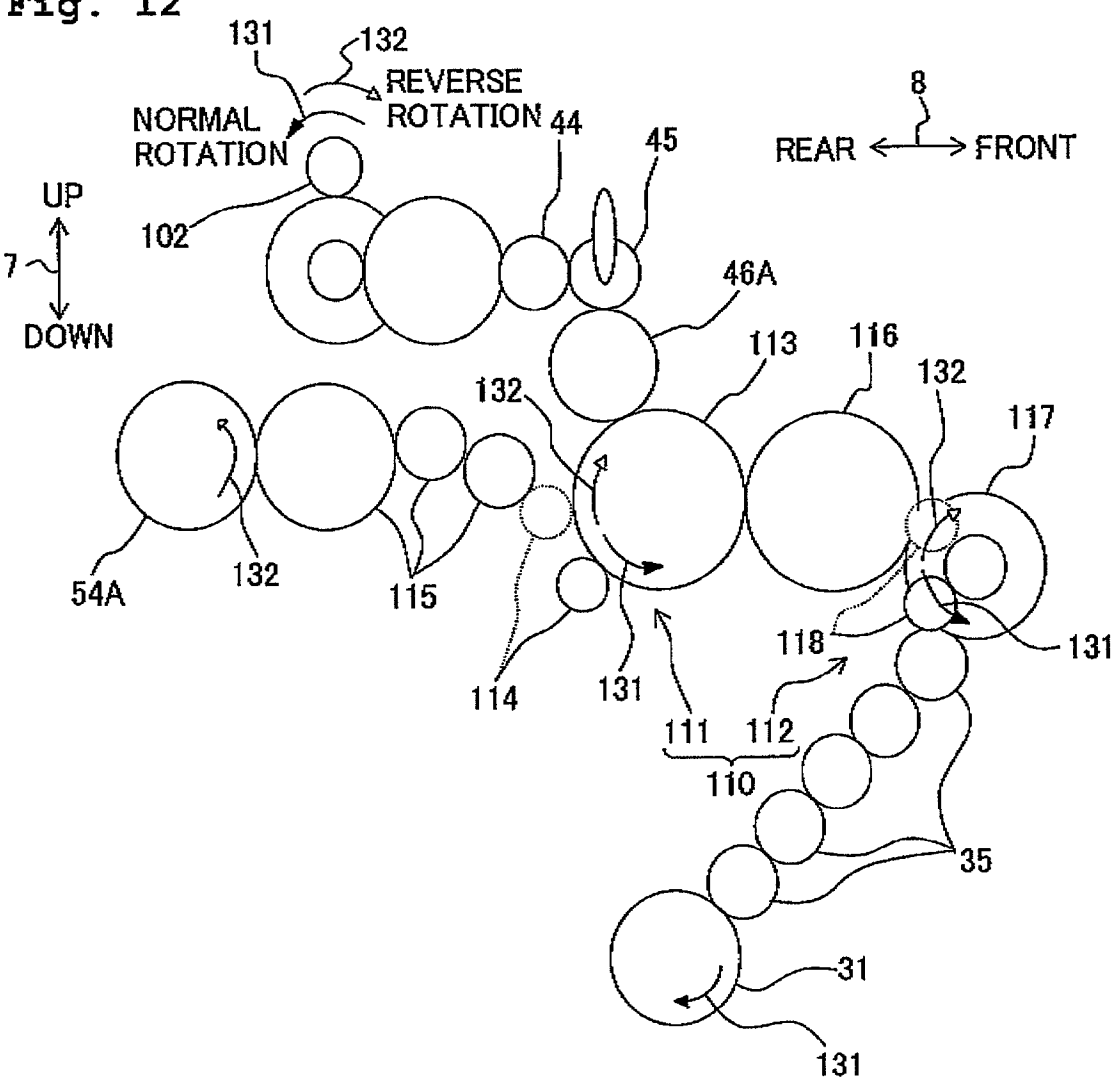
FIG. 12 is a schematic plan view showing a first transmitting section.

As shown in FIG. 12, the first transmitting section 110 includes a first planetary gear mechanism 111 and a second planetary gear mechanism 112. The first planetary gear mechanism 111 includes a sun gear 113 that engages with the first receiving gear 46A, and a planet gear 114 that rotates while revolving around the sun gear 113. As shown by a dotted line in FIG. 12, when the second drive motor 102 is reversely rotated in a direction of an arrow mark 132, the planet gear 114 engages with one of a plurality of transmission gears 115 which transmit the rotation to the rotary shaft 54A of the intermediate roller pair 54. The second planetary gear mechanism 112 includes a sun gear 117 to which a rotation of the sun gear 113 is transmitted by a transmission gear 116, and a planet gear 118 that rotates while revolving around the sun gear 117. As shown by a solid line in FIG. 12, when the second drive motor 102 is normally rotated in a direction of an arrow mark 131, the planet gear 118 engages with one of the plurality of transmission gears 35 that transmit the rotational force to the first feeding roller 31. The first transmitting section 110 is structured to transmit the driving force of the normally-rotated second drive motor 102 to the first feeding roller 31 and to transmit the driving force of the reversely-rotated second drive motor 102 to the intermediate roller pair 54. At the same time, the first transmitting section 110 is structured not to transmit the driving force of the reversely-rotated second drive motor 102 to the first feeding roller 31. The normal rotation of the second drive motor 102 in the present embodiment corresponds to a normal rotation of the second drive motor in the present teaching, and the reverse rotation of the second drive motor 102 corresponds to a reverse rotation of the second drive motor in the present teaching.

[Second Transmitting Section 120]

Figure 13:
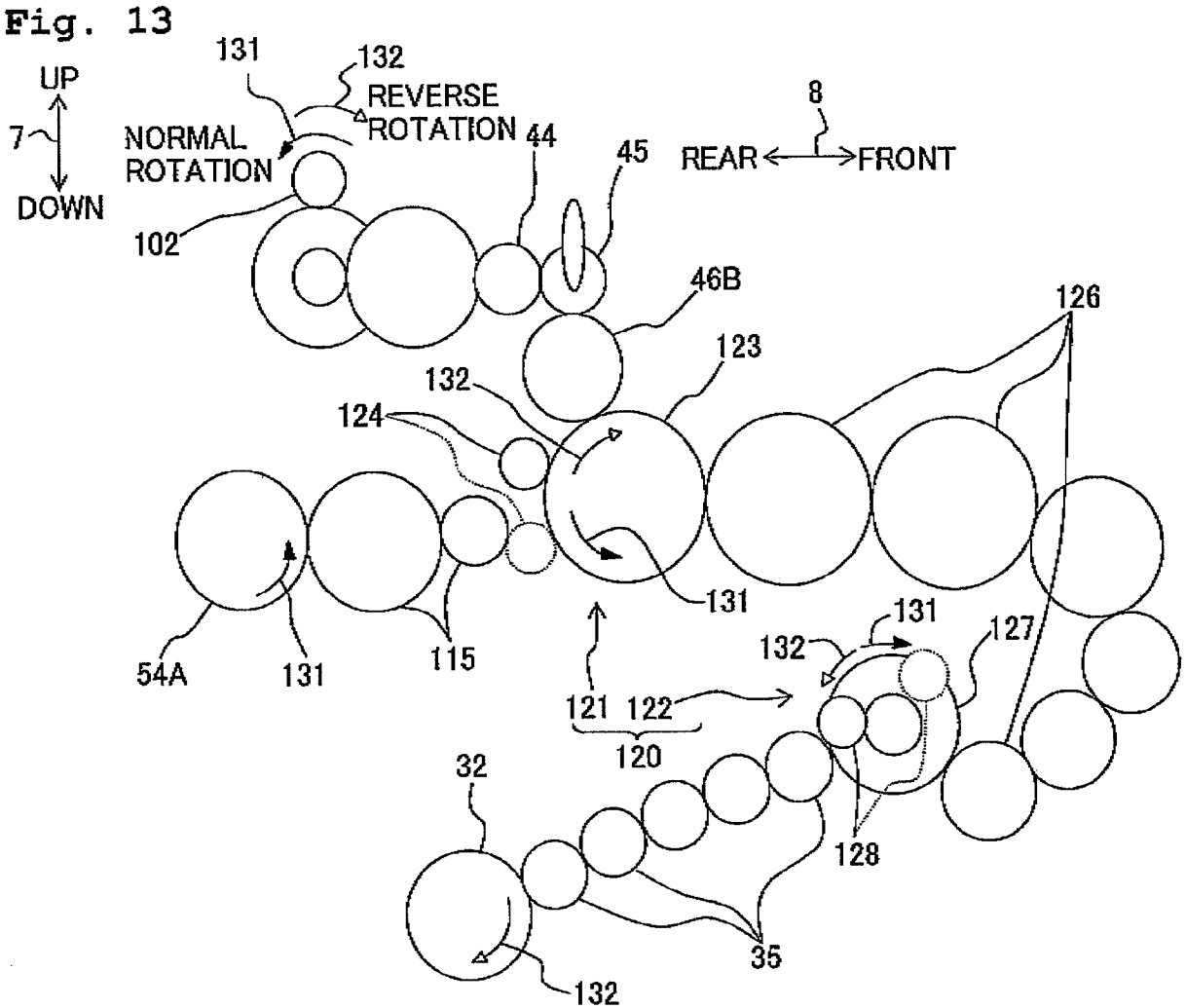
FIG. 13 is a schematic plan view showing a second transmitting section.

As shown in FIG. 13, the second transmitting section 120 has a structure similar to that of the first transmitting section 110, and includes two planetary gear mechanisms of a third planetary gear mechanism 121 and a second planetary gear mechanism 122. Further, the second transmitting section 120 is structured so that the second transmitting section 120 transmits the driving force of the second drive motor 102 that reversely rotates (refer to the arrow mark 132) in the direction of the arrow mark 132 to the second feeding roller 32 and that the second transmitting section 120 transmits the driving force of the second drive motor 102 that normally rotates in the direction of the arrow mark 131 to the intermediate roller pair 54. At the same time, the second transmitting section 120 is structured not to transmit the driving force of the normally-rotated second drive motor 102 to the second feeding roller 32.

[Detecting Mechanism]

A detecting mechanism includes: a first sensor 81 and a second sensor 82 as shown in FIG. 2; and a first linear encoder 83, a second encoder 84 and a third encoder 85 as shown in FIG. 11. The first sensor 81 is disposed on an upstream side of the intermediate roller pair 54 in the transporting direction 38 in the main transporting route 51. The second sensor 82 is disposed on an upstream side of the main transporting roller pair 55 in the transporting direction 38 in the main transporting route 51.

The first sensor 81 and the second sensor 82 are so-called register sensors, and since a structure thereof is similar to that of well-known register sensors, detailed explanation will be omitted. Each of the first and second sensors 81 and 82 includes, for example, a light-emitting diode, a photodiode, and a detector provided to be able to be inserted into or retracted from the main transporting route 51, and is structured so that an output during when the paper 5 passes through the sensor is different from an output when the paper 5 does not pass through the sensor. The outputs of the first sensor 81 and the second sensor 82 during when the paper 5 passes through the sensors are defined as first outputs, and the outputs thereof when the paper 5 does not pass through the sensors are defined as second outputs. The first sensor 81 corresponds to a detecting section in the present teaching, and the first output and the second output correspond to a first output and a second output, respectively, in the present teaching.

The encoder has a structure similar to that of a well-known encoder. The encoder includes, for instance, a light-emitting diode, a photodiode, and a disk attached to a shaft of a drive motor or a rotary shaft, in which a light-transmitting portion that transmits light and a light-shielding portion that shields light are provided to the disk. When the disk rotates, the light-transmitting portion and the light-shielding portion alternately pass over an optical path of the light-emitting diode, and an output of the photodiode changes. The first linear encoder 83 is provided to the rail bodies 24. An encoder strip is disposed on the first linear encoder. The first linear encoder 83 detects the encoder strip using a photo interrupter provided to the carriage 23. Based on a detection signal of the first linear encoder 83, the reciprocating movement of the carriage 23 is controlled. Specifically, the first linear encoder 83 includes the encoder strip and the photo interrupter, and detects the position of the carriage 23. The second encoder 84 is provided to the second drive motor 102 in an attached manner. The third encoder 85 is provided to the third drive motor 103 in an attached manner.

The control section 90 includes: a first counter 91 counting a change in an output of the first linear encoder 83; a second counter 92 counting a change in an output of the second encoder 84; a third counter 93 counting a change in an output of the third encoder 85; a timer counter 94; and a memory 95. The timer counter 94 includes, for instance, an oscillation circuit and a frequency dividing circuit, and counts a period of time as a digital value. The second encoder 84 and the second counter 92 correspond to a counting mechanism in the present teaching.

The memory 95 stores first to tenth predetermined values. The first predetermined value is a threshold value of the second counter 92, and is set as a value indicating that at least a predetermined rotation quantity is obtained after a tip of the paper 5 that passes through the first sensor 81 reaches the intermediate roller pair 54. The second predetermined value is a threshold value of the second counter 92, and is set as a value indicating that at least a predetermined rotation quantity is obtained after the tip of the paper 5 reaches the main transporting roller pair 55. The third predetermined value is a value of the first counter 91, which is a value for making the carriage 23 move from a position thereof detected by the first linear encoder 83 to the standby position at the right end, and is changed in accordance with the position of the carriage 23. The fourth predetermined value is a threshold value of the first counter 91, and is a value for stopping the carriage 23 at a position at which the posture of the switching gear 45 is changed to the second posture. The fifth predetermined value is a threshold value of the timer counter 94, and is set to a value sufficient for making the carriage 23 reach from the right end to the left end of the rail bodies 24. The sixth predetermined value is a set value of the number of times of driving of the second drive motor 102 in later-described switching processing. The seventh predetermined value is set to a value sufficient for making the cap 61 move between the aforementioned abutting position and the separating position. The eighth predetermined value is a threshold value of the third counter 93, and is a value that determines a start of feeding of the paper 5. The ninth predetermined value is a threshold value of the third counter 93, and is a value that determines a linefeed width. The eighth predetermined value and the ninth predetermined value are, for example, externally input as image data to be stored in the memory 95. The tenth predetermined value is a value for judging whether or not the gear switching is normally conducted, and corresponds to a predetermined amount in the present teaching. The memory 95 corresponds to a memory in the present teaching.

Next, an operation of the control section 90 will be described while referring to FIGS. 8 to 11.

[Standby Mode]

Figure 8:
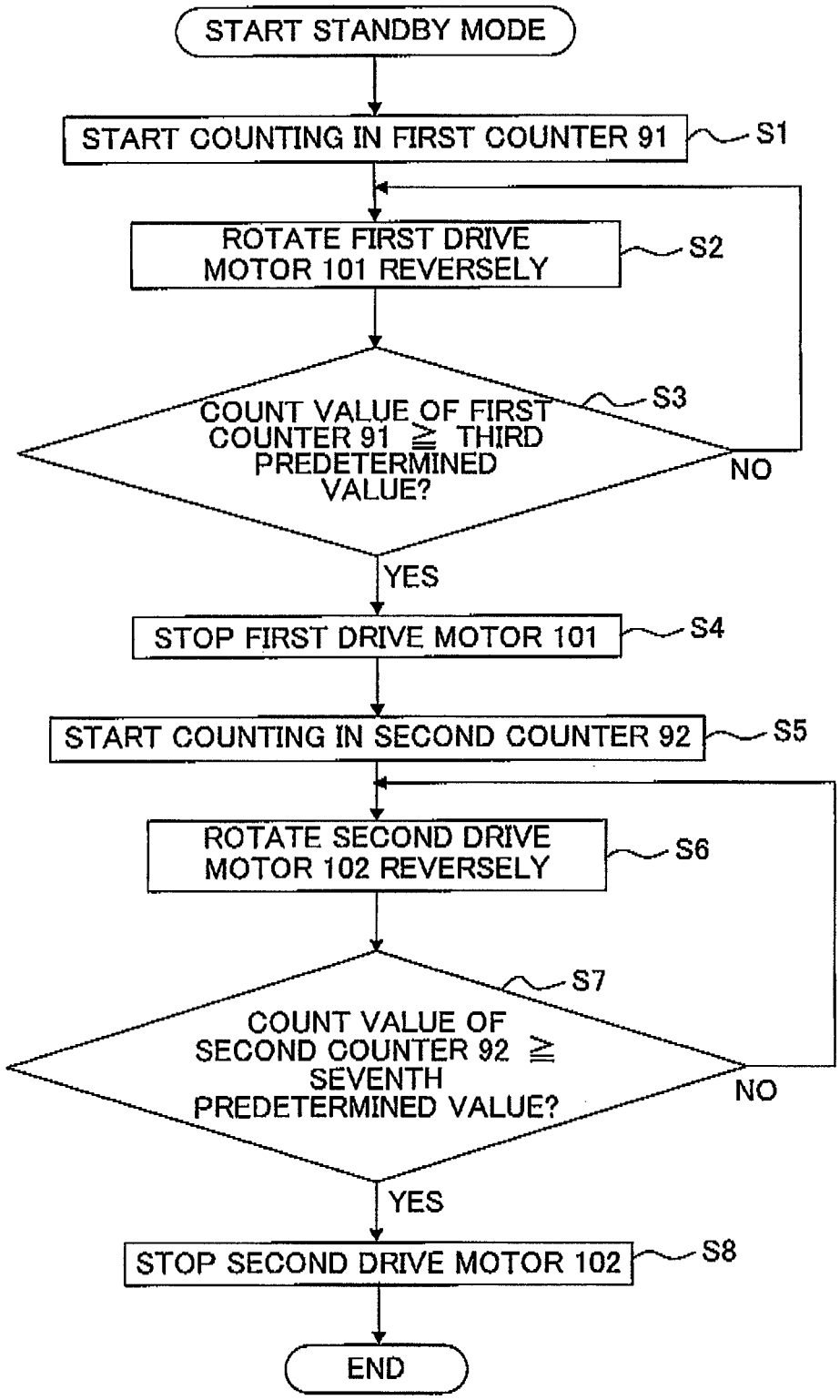
FIG. 8 is a flow chart representing processing of a control section in a standby mode.

At first, description will be made on processing conducted by the control section 90 in the standby mode as shown in FIG. 8. The standby mode corresponds to a standby mode in the present teaching. When the operation button 18 (refer to FIG. 1) is operated and an instruction of power-off is made, the control section 90 calculates a movement amount of the carriage 23 required for moving from its current position to the third posture as the third predetermined value, and starts counting in the first counter 91 (S1). The control section 90 reversely rotates the first drive motor 101 (S2), moves the carriage 23 in the right direction, and changes the posture of the switching gear 45 to the third posture. When the control section 90 judges that the carriage 23 is moved to the right end of the rail bodies 24 based on the fact that the counter value of the first counter 91 becomes the third predetermined value (S3, Y), the control section 90 stops the first drive motor 101 (S4). Subsequently, the control section 90 starts counting in the second counter 92 (S5), and at the same time, the control section 90 reversely rotates the second drive motor 102 (S6), thereby moving the cap 61 in the upward direction. Thereafter, when the control section 90 judges that the cap 61 is moved to the position at which the cap 61 covers the jetting ports of the nozzles based on the fact that the count value of the second counter 92 becomes the seventh predetermined value (S7, Y), the control section 90 stops the second drive motor 102 (S8). When the cap 61 covers the jetting ports of the nozzles, the multifunction machine 10 turns into the standby state. Note that when the gear is switched by moving the switching gear 45 with the use of the abutting piece 26 provided to the carriage 23, the control section 90 performs the later-described switching processing. The processing in the standby mode described above is an example, and the present teaching is not limited to this.

Next, description will be made on releasing processing of the standby mode. When the power is applied, the control section 90 starts counting in the timer counter 94, and normally rotates the second drive motor 102 to lower the cap 61. When the control section 90 judges that the posture of the cap 61 is changed from the abutting posture to the separating posture based on the fact that the count value of the timer counter 94 becomes equal to or larger than the seventh predetermined value, the control section 90 stops the driving of the second drive motor 102, starts counting in the timer counter 94, normally rotates the first drive motor 101 to move the carriage 23 in the left direction, and changes the posture of the switching gear 45 from the third posture to the first posture. When the control section 90 judges that the carriage 23 is moved completely to the left end based on the fact that the count value of the timer counter 94 reaches the fifth predetermined value, the control section 90 stops the first drive motor 101 and initializes the first counter 91. Specifically, even when the carriage 23 is moved by a user during when the power is turned off; the control section 90 can judge the position of the carriage 23 by moving the carriage 23 to the left end and initializing the first counter 91. The releasing processing of the standby mode described above is an example, and it is also possible to adopt another releasing processing of the standby mode.

[High-Speed Printing Mode]

Figure 9A:
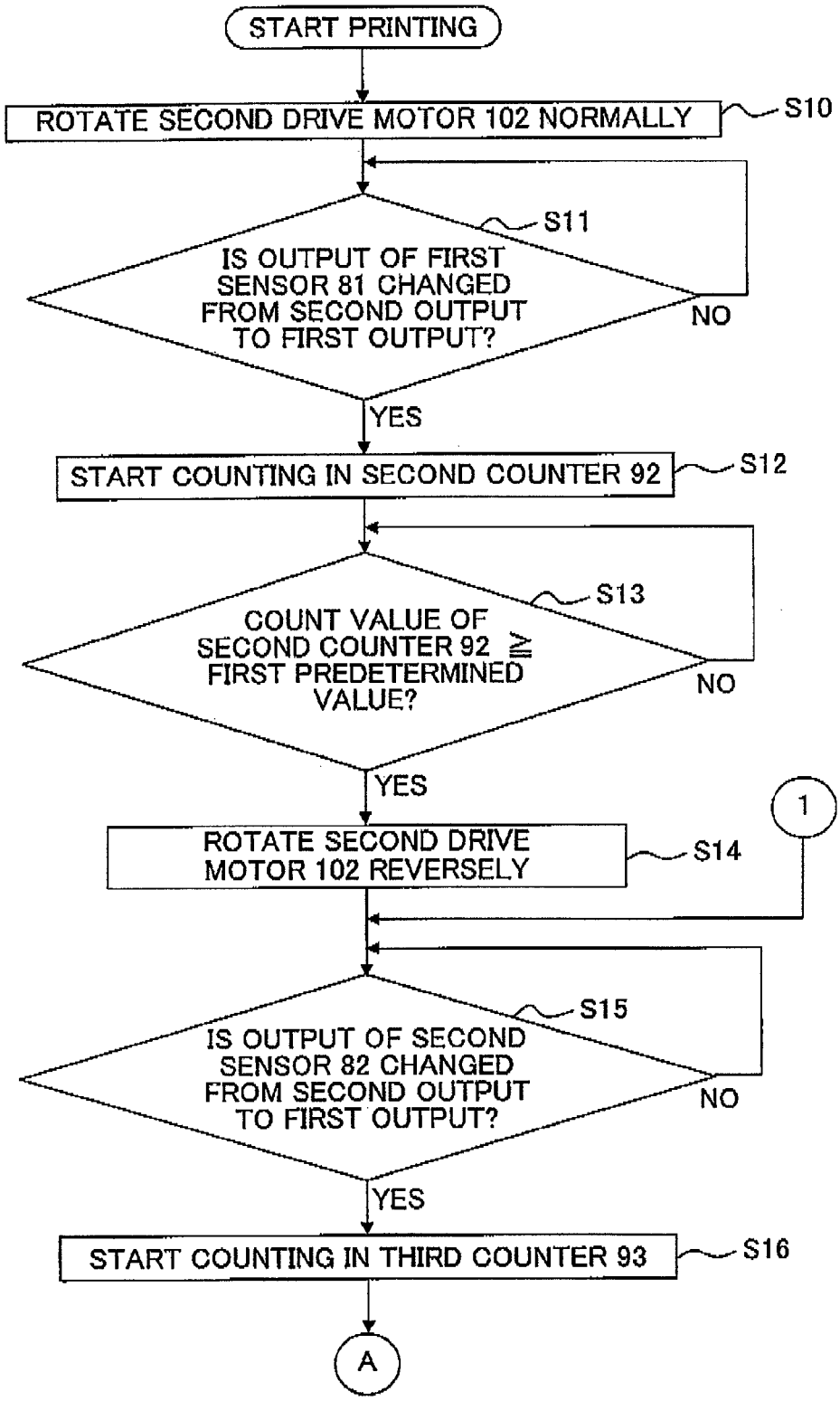
FIGS. 9A, 9B, 9C and 9D are flow charts representing processing of the control section in a high-speed printing mode.
Figure 9B:
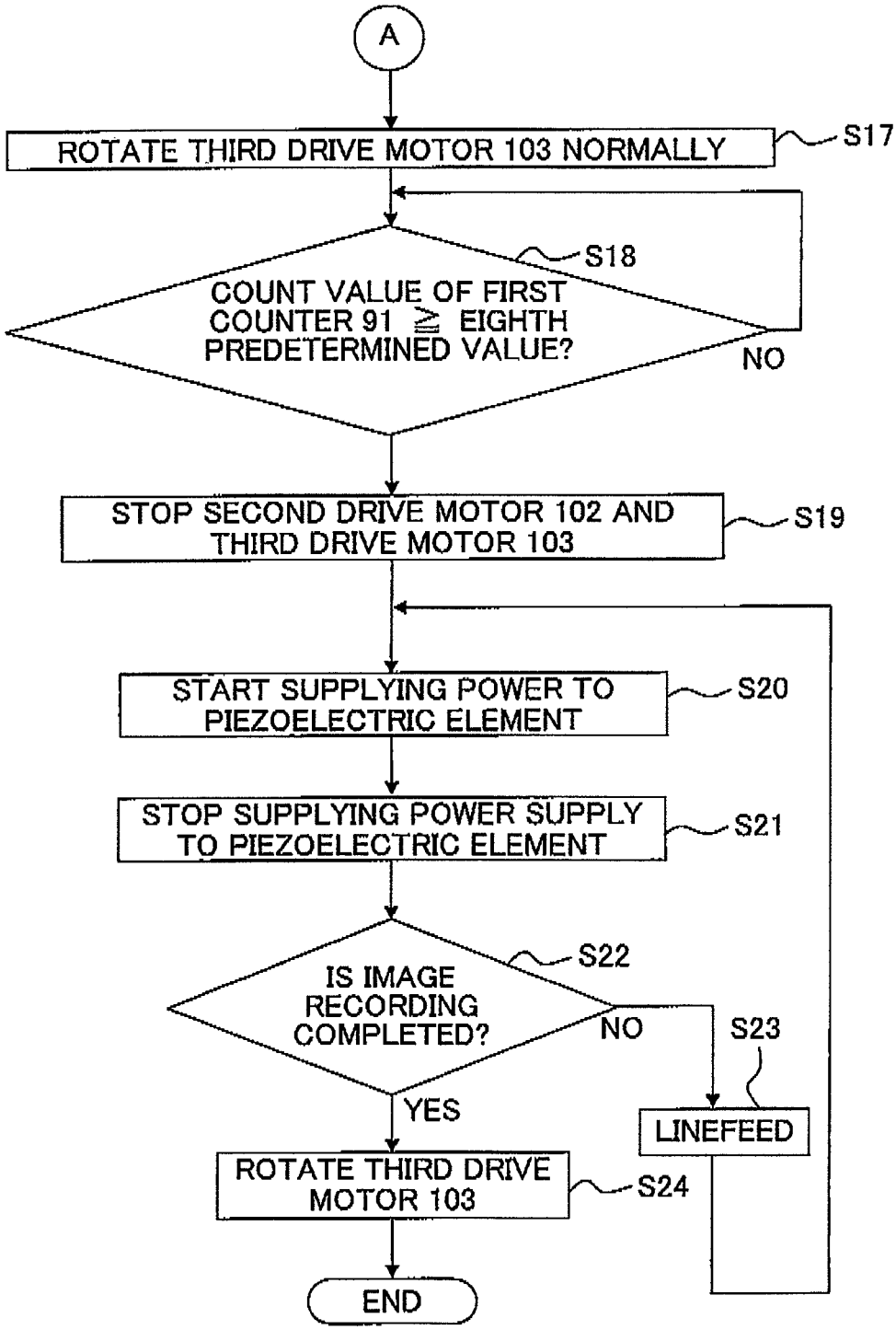
Figure 9C:
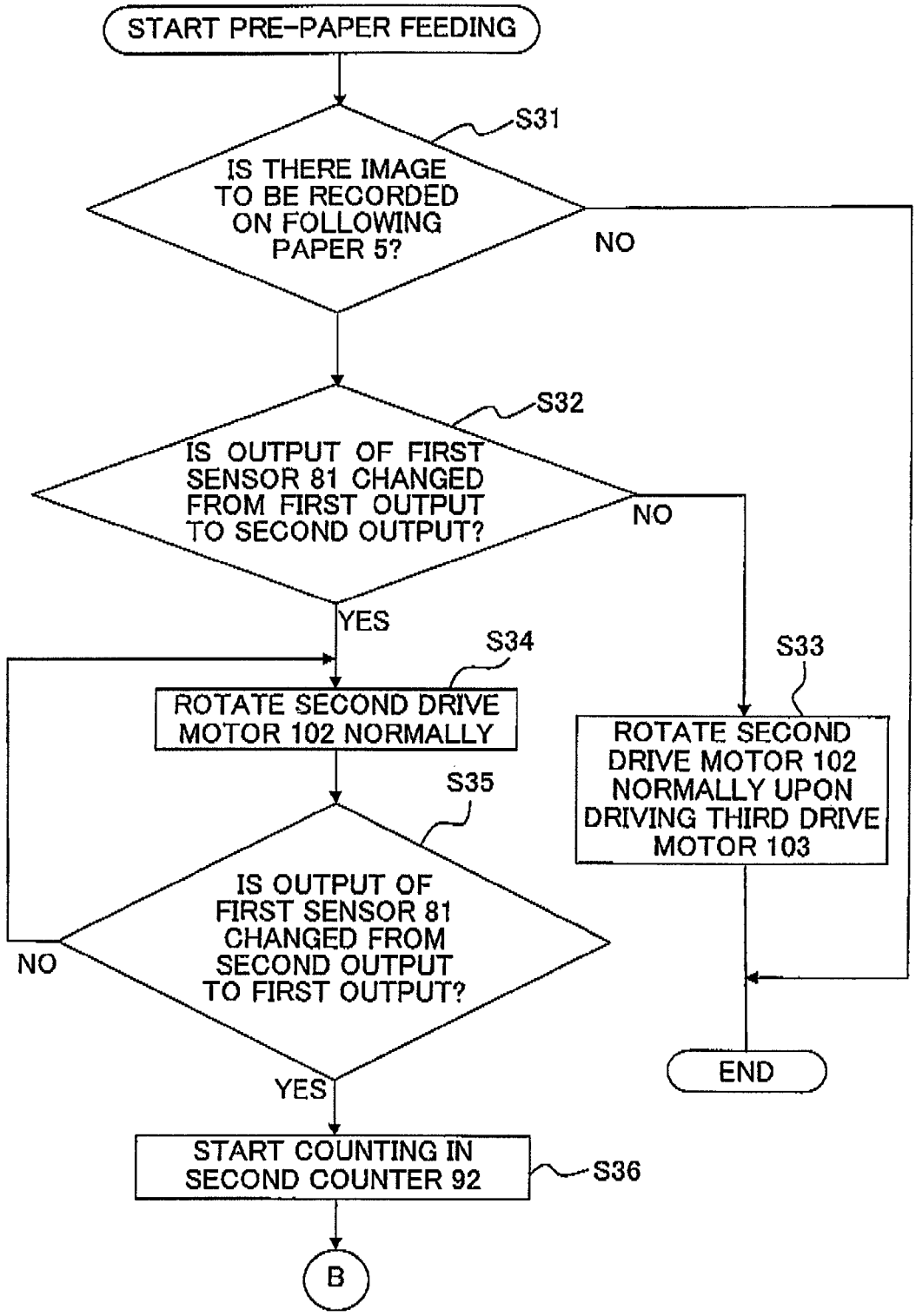
Figure 9D:
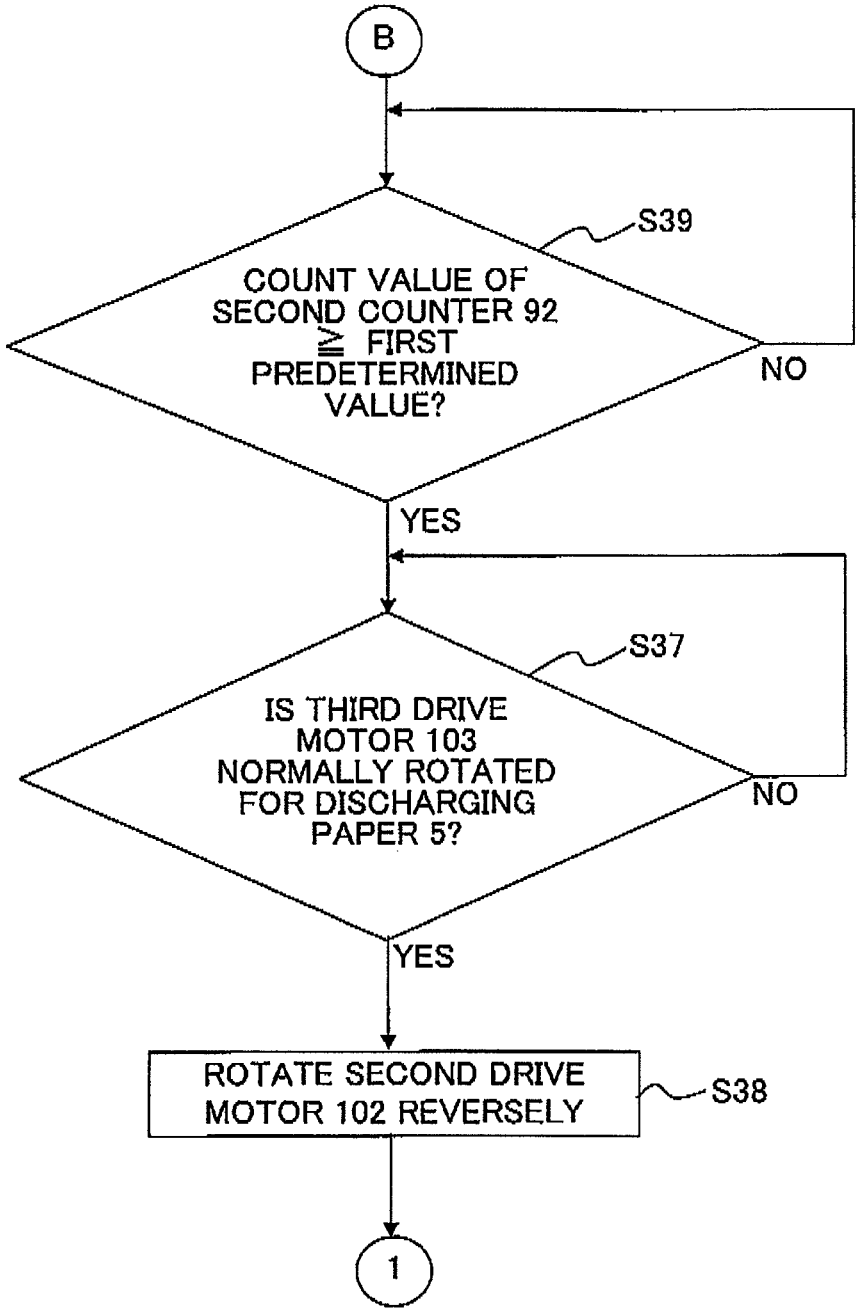

Next, description will be made on processing conducted by the control section 90 in the high-speed printing mode. The high-speed printing mode corresponds to a high-speed printing mode in the present teaching. The high-speed printing mode includes printing processing as shown in FIG. 9A and pre-paper feeding processing as shown in FIG. 9B. When the printing is instructed in the high-speed printing mode, the control section 90 conducts the aforementioned releasing processing, and after that, in the printing processing, the control section 90 normally rotates the second drive motor 102 to rotate the first feeding roller 31 (S10), and feeds the paper 5 from the upper tray 14 to the main transporting route 51. Next, when the control section 90 detects that the output of the first sensor 81 is changed from the second output to the first output because of the fed paper 5 (S11, Y), the control section 90 starts counting in the second counter 92 (S12). When the control section 90 judges that the paper 5 is abutted on the intermediate roller pair 54 based on the fact that the count value of the second counter 92 becomes the first predetermined value (S13, Y), it reversely rotates the second drive motor 102 to rotate the intermediate roller pair 54 (S14), and transports the paper 5 toward the main transporting roller pair 55. Specifically, the paper 5 is abutted on the intermediate roller pair 54 and a slanted movement thereof is corrected, and thereafter, the paper 5 is transported toward the main transporting roller pair 55.

When the control section 90 detects that the output of the second sensor 82 is changed from the second output to the first output because of the paper 5 transported by the intermediate roller pair 54 (S15), the control section 90 starts counting in the third counter 93 (S16), normally rotates the third drive motor 103 (S17), and transports the paper 5 toward the paper discharge roller pair 56 with the use of the main transporting roller pair 55. When the control section 90 judges that the start of feeding is completed based on the fact that the count value of the third counter 93 becomes the eighth predetermined value (S18, Y), the control section 90 stops the rotation of the second drive motor 102 and the third drive motor 103 (S19). Thereafter, the control section 90 starts the supply of power to the piezoelectric element (S20), and terminates the supply of power to the piezoelectric element (S21). When the control section 90 judges that the image recording is not completed (S22, N), the control section 90 conducts linefeed processing (S23), and then starts the supply of power to the piezoelectric element (S20) and terminates the supply of power to the piezoelectric element (S21). In the linefeed processing in step S23, the control section 90 normally rotates the third drive motor 103, and thereafter, when the count value of the third counter 93 becomes the ninth predetermined value, the control section 90 stops the third drive motor 103, and transports the paper 5 in the forward direction by a predetermined linefeed width. By alternately conducting the linefeed processing in step S23 and ink-jet processing in steps S20 and S21, the control section 90 controls the recording head 21 to record the image on the paper 5. When the control section 90 judges that the image recording is completed (S22, Y), the control section 90 normally rotates the third drive motor 103 to discharge the paper 5 to the paper discharge tray 16 (S24). Note that the control based on the detection of the first sensor 81 and the second sensor 82 is an example, and the present teaching is not limited to such a structure. For example, it is also possible to determine a timing for driving the second drive motor 102 and the third drive motor 103 using another sensor.

[Pre-Paper Feeding Processing]

The pre-paper feeding processing in FIG. 9B is carried out in the linefeed processing in step S23 in FIG. 9A. The control section 90 judges whether or not there is an image to be recorded on the following paper 5 (S31), and when there is no image to be recorded on the following paper 5 (S31, N), the control section 90 terminates the pre-paper feeding processing. When there is the image to be recorded on the following paper 5 (S31, Y), the control section 90 judges whether or not an end of the precedently fed paper 5 reaches the first sensor 81 based on the fact that the output of the first sensor 81 is changed from the first output to the second output (S32). When the end of the precedently fed paper 5 does not reach the first sensor 81 (S32, N), the control section 90 normally rotates the second drive motor 102 during when the third drive motor 103 is driven (S33), and terminates the pre-paper feeding processing. At this time, when a rear end of the precedently fed paper 5 has already passed through the first paper feeding roller 31, the following paper 5 is fed. Further, since a transporting force of the first paper feeding roller 31 is smaller than a transporting force of the main transporting roller pair 55, even if the rear end of the precedently fed paper 5 has not yet passed through the first paper feeding roller 31, it is possible to transport the paper 5 with the use of the main transporting roller pair 55. Here, the transporting force is determined by a nip force and a frictional force of each of the rollers with respect to the paper. In addition, the number of rotations or a time of rotation of the second drive motor 102 is set so that a feeding amount of the paper 5 fed by the first feeding roller 31 becomes smaller than a linefeed width in the linefeed processing. Further, a rotational speed of the second drive motor 102 is set at a constant ratio so that the rotational speed of the second drive motor 102 becomes smaller than a rotational speed of the third drive motor 103 in the aforementioned linefeed processing. Therefore, there is no chance that a tip of the paper 5 fed in the pre-paper feeding processing abuts on the rear end of the precedently fed paper 5, and it is possible to detect the rear end of the precedently fed paper 5 using the first sensor 81. Further, since the first feeding roller 31 is intermittently rotated, overlapping papers 5 are separated to be fed to the main transporting route 51. Note that the driving of the second drive motor 102 can also be conducted in all of a plurality of drive periods of the third drive motor 103, or can also be conducted selectively (in the third, fifth and seventh drive periods, for example). Therefore, when a rear end of a precedently fed paper 5*a* has not yet passed through the first sensor 81, and until when the output of the first sensor 81 is changed from the first output to the second output, the control section 90 normally rotates the second drive motor 102 during the drive period of the third drive motor 103 in the linefeed processing in step S16. Accordingly, it is possible to feed a paper 5*b* to be fed later during when the recording is performed on the precedently fed paper 5*a*.

Next, when the control section 90 judges, in step S32, that the end of the precedently fed paper 5 reaches the first sensor 81 based on the fact that the output of the first sensor 81 is changed from the first output to the second output (S32, Y), the control section 90 normally rotates the second drive motor 102 (S34). The control section 90 judges whether or not a tip of a later-fed paper 5 reaches the first sensor 81 based on the change in the output of the first sensor 81 from the second output to the first output (S35). When the control section 90 judges that the tip of the paper 5 does not reach the first sensor 81 (S35, N), the control section 90 continuously conducts the normal rotation of the second drive motor 102. When the control section 90 judges that the tip of the paper 5 reaches the first sensor 81 (S35, Y), it starts counting in the second counter 92 (S36), continuously conducts the normal rotation of the second drive motor 102 until when the control section 90 judges that the count value of the second counter 92 becomes the first predetermined value (S39, N), and performs register correction using the intermediate roller pair 54. When the control section 90 judges, in step S39, that the count value of the second counter 92 becomes the first predetermined value (S39, Y), and besides, when the control section 90 judges that the third drive motor 103 is normally rotated for discharging the precedently fed paper 5 (S37, Y), the control section 90 reversely rotates the second drive motor 102, and transports the paper 5 which is made on standby at the intermediate roller pair 54 toward the main transporting roller pair 55 (S38). Specifically, a start of feeding of the later-fed paper 5 is conducted in conjunction with a discharge operation of the precedently fed paper 5. The control section 90 performs, after step S38, processings in step S15 and thereafter.

[High-Precision Printing Mode]

Next, description will be made on an operation of the control section 90 in a high-precision printing mode. When the printing is instructed in the high-precision printing mode, the control section 90 conducts the aforementioned releasing processing, and after that, the control section. 90 starts counting in the first counter 91, and reversely rotates the first drive motor 101 to move the carriage 23 in the right direction. When the control section 90 judges that the posture of the switching gear 45 is changed to the second posture by the abutting piece 26 based on the fact that the count value of the first counter 91 becomes the fourth predetermined value, the control section 90 stops the first drive motor 101. Thereafter, the control section 90 reversely rotates the second drive motor 102 to rotate the second feeding roller 32, and feeds the paper 5 from the lower tray 15 to the main transporting route 51. Next, the control section 90 performs control similar to that of the printing processing, makes the paper 5 abut on the intermediate roller pair 54 to perform registration correction, and after that, the control section 90 normally rotates the second drive motor 102 to transport the paper 5 toward the main transporting roller pair 55 using the intermediate roller pair 54. When the control section 90 detects that the output of the second sensor 82 is changed from the second output to the first output by the transported paper 5, the control section 90 starts counting in the second counter 92. When the control section 90 judges that the tip of the paper 5 abuts on the main transporting roller pair 55 based on the fact that the count value of the second counter 92 becomes the second predetermined value, the control section 90 normally rotates the third drive motor 103. Specifically, in the high-precision printing mode, the registration correction is performed using each of the two roller pairs of the intermediate roller pair 54 and the main transporting roller pair 55. Thereafter, similar to the aforementioned printing processing, the control section 90 controls the transporting mechanism 30 and the recording head 21 to perform the start of feeding, the linefeed and the jetting of ink, thereby recording an image on the paper 5. Note that in the above description, so-called static register correction in which the main transporting roller pair 55 which is in a stationary state is normally rotated is explained. However, the present teaching is not limited to such a structure. For example, it is also possible to adopt a structure in which the slanted movement of the paper 5 is corrected using so-called reverse register correction in which the reversely-rotated main transporting roller pair 55 is normally rotated. Further, it is also possible to correct the slanted movement of the paper 5 using so-called return register correction in which the tip of the paper 5 is once passed through the main transporting roller pair 55, and thereafter, the main transporting roller pair 55 is reversely rotated to make the tip of the paper 5 abut on the main transporting roller pair 55.

[Switching Processing]

Figure 10:
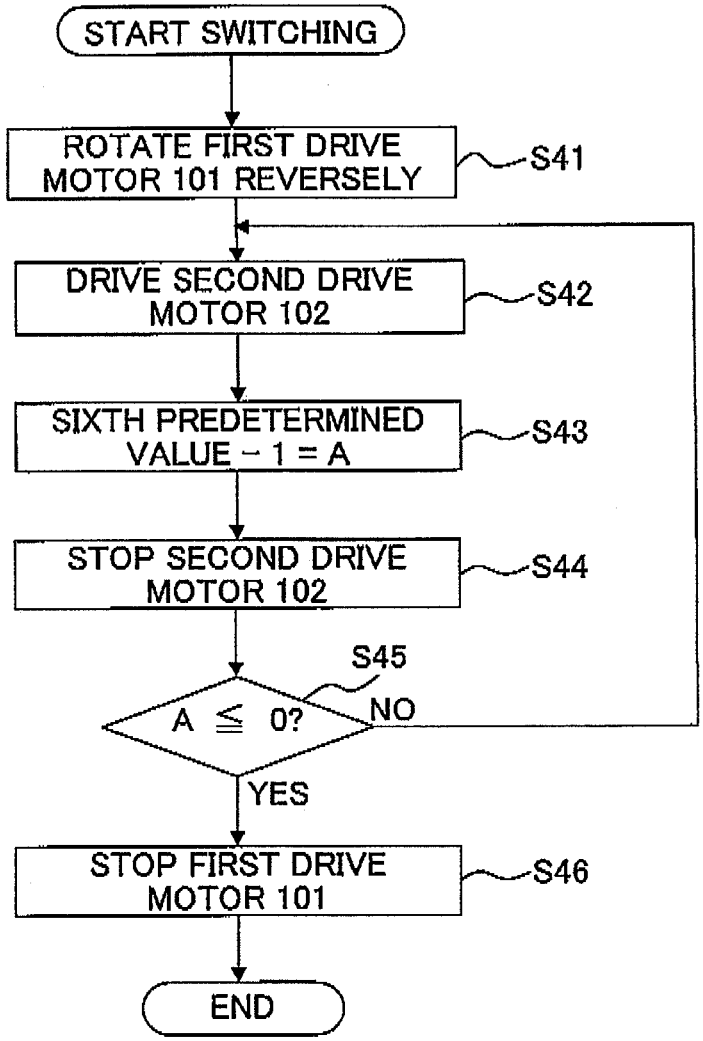
FIG. 10 is a flow chart representing processing of the control section in switching processing.

Next, description will be made on the switching processing when the control section 90 drives the first drive motor 101 to move the switching gear 45. As shown in FIG. 10, the control section 90 reversely rotates the first drive motor 101 (S41), changes the posture of the switching gear 45 using the abutting piece 26 of the carriage 23, normally rotates or reversely rotates the second drive motor 102 (S42), and then stops the second drive motor 102 (S44). At that time, the control section 90 performs calculation to reduce the value of the sixth predetermined value (S43), and when the control section 90 judges that a calculated value A does not become zero (S45, N), it again performs the driving and stopping of the second drive motor 102. When the control section 90 judges that the calculated value A becomes zero (S45, Y), the control section 90 stops the first drive motor 101 (S46). Since the switching gear 45 is intermittently rotated and is also continuously pushed by the carriage 23, a probability of enabling normal change in posture of the switching gear 45 from the first posture to the second posture or the third posture becomes high. The switching processing corresponds to switching processing in the present teaching. Note that FIG. 10 shows control sequences at a time of changing the posture of the switching gear 45 from the first posture to the second posture or the third posture. In these control sequences, when the posture of the switching gear 45 is changed from the third posture to the first posture, the first drive motor 101 is stopped at a point in time at which the carriage 23 is moved to the left end. The switching gear 45 is pushed by the first elastic member. Further, in the above description, a structure in which the second drive motor 102 is driven a predetermined number of times is explained, but, the present teaching is not limited to such a structure. For instance, the second drive motor 102 can also be intermittently rotated for a predetermined period of time, not the predetermined number of times.

Next, description will be made on control of the control section 90 when the gear switching is not normally conducted. The control section 90 normally rotates or reversely rotates the second drive motor 102 to feed the paper 5, and starts counting in the second counter 92. When the control section 90 judges that the paper 5 is not fed based on the fact that the output of the first sensor 81 does not change from the second output to the first output even when the count value of the second counter 92 becomes the tenth predetermined value, the control section 90 again performs the aforementioned switching processing, and again performs the feeding of the paper 5 by normally rotating or reversely rotating the second drive motor 102. When the output of the first sensor 81 still does not change from the second output to the first output, the control section 90 judges that there is no paper 5, and carries out error display and the like. Specifically, the intermediate roller pair 54 is rotated after the paper 5 is confirmed to be fed.

As described above, in the present embodiment, the normal rotation of the second drive motor 102 is used for driving the first feeding roller 31, and the reverse rotation of the second drive motor 102 is used for driving the second feeding roller 32. For this reason, even when the gear switching of the switching gear 45 cannot be normally conducted, there is no chance of erroneous feeding of the paper 5. Further, the intermediate roller pair 54 is rotated after confirming that the paper 5 is fed, so that the occurrence of erroneous paper feeding can be prevented at the time of performing control for rotating the intermediate roller pair 54. Further, after feeding the paper 5 to the main transporting route 51, it is possible to drive the intermediate roller pair 54 only by changing the direction of rotation of the second drive motor 102, so that an occurrence of paper jam caused by the wrong gear switching during the transporting of the paper 5 can be prevented. As a result of this, there is realized a multifunction machine 10 capable of reducing the number of drive motors to be used and preventing erroneous paper feeding and paper jam.

Further, when the high-speed printing mode is conducted, the paper 5 is fed from the upper tray 14. The first feeding roller 31 provided to the upper tray 14 in an attached manner is driven by the first receiving gear 46A, and the first receiving gear 46A engages with the switching gear 45 in the first posture. The number of gear switching when the posture of the switching gear 45 is changed from the third posture being the standby posture to the first posture is smaller than that when the posture is changed from the third posture to the second posture. Accordingly, the number of gear switching of the switching gear 45 can be reduced when the mode is shifted from the standby mode to the high-speed printing mode, so that it is possible to suppress an occurrence of operation failure at the time of conducting the high-speed printing in the multifunction machine 10.

Further, similar to the driving of the first feeding roller 31, the cap 61 is detached from the nozzles by the normal rotation of the first drive motor 101. For this reason, when the printing is performed in the high-speed printing mode, even if the gear is wrongly switched, the cap 61 does not cover the jetting ports of the nozzles of the recording head 21, and there is no need for moving the cap 61 when the gear is tried to be switched again. As a result of this, there is provided a multifunction machine 10 which is configured to reduce the number of times of operations or operating time of the first drive motor 101 and to reduce the operating noise and operating time when the wrong gear switching occurs.

In the present embodiment, description is made by citing a structure capable of performing single-sided printing, as an example, but, it is also possible to apply the present teaching to a multifunction machine 10 capable of performing double-sided printing by providing a well-known reverse transporting route. Further, description is made by citing a structure in which the drive transmission switching mechanism 40 includes the three receiving gears 46A, 46B and 46C, as an example, but, it is also possible that the drive transmission switching mechanism 40 includes four or more of receiving gears. Further, when the printing is performed on the paper 5 mounted on the lower tray 15, it is not limited to the aforementioned high-precision printing mode.

Further, although the present embodiment describes the multifunction machine 10 including the upper tray 14 and the lower tray 15, it is also possible that the multifunction machine 10 includes a manual feeding tray instead of the lower tray 15, and performs so-called bypass printing with the use of the manual feeding tray. In the present embodiment, the present teaching is applied to the multifunction machine 10 which is an example of the image recording apparatuses. However, the application objective of the present teaching is not limited thereto. That is, the present teaching is applicable to any image recording apparatuses such as an ink-jet printer having a printing function only.

What is claimed is:

1. An image recording apparatus which jets an ink to record an image on a sheet-type recording medium, comprising:

a first mounting portion and a second mounting portion each on which the recording medium are mounted;

a first feeding roller which feeds the recording medium mounted on the first mounting portion;

a second feeding roller which feeds the recording medium mounted on the second mounting portion;

a recording head which jets the ink onto the recording medium fed by one of the first feeding roller and the second feeding roller;

a carriage which holds the recording head to move in a direction orthogonal to a transporting direction of the recording medium;

a first drive motor which reciprocates the carriage;

a second drive motor which rotates in a normal direction and a reverse direction; and a drive transmission switching mechanism which transmits a driving force of the second drive motor to the first feeding roller and the second feeding roller, the drive transmission switching mechanism includes:

a first gear of which a rotation axis is directed in a moving direction of the carriage and which is rotated by the second drive motor;

a supporting shaft of which axial direction is directed in the moving direction;

a second gear through which the supporting shaft is inserted, which is moved in the moving direction by the carriage, which changes its posture to a first posture and a second posture while being moved in the moving direction, and which engages with the first gear in the first and second postures;

a third gear of which rotation axis is directed in the moving direction and which engages with the second gear in the first posture;

a fourth gear of which rotation axis is directed in the moving direction and which engages with the second gear in the second posture;

a first transmitting section which transmits a rotation of the third gear rotated by the second drive motor rotating in the normal direction to the first feeding roller to rotate the roller in a direction in which the recording medium is fed; and which prevents transmission of rotation of the third gear rotated by the second drive motor rotating in the reverse direction to the first feeding roller, under a condition that the second gear is in the first posture; and a second transmitting section which transmits a rotation of the fourth gear rotated by the second drive motor rotating in the reverse direction to the second feeding roller to rotate the roller in the direction in which the recording medium is fed; and which prevents transmission of rotation of the fourth gear rotated by the second drive motor rotating in the normal direction to the second feeding roller, under a condition that the second gear is in the second posture.

2. The image recording apparatus according to claim 1, further comprising an intermediate roller pair nipping and transporting the recording medium, wherein the first transmitting section transmits the rotation of the third gear rotated by the second drive motor rotating in the reverse direction to the intermediate roller pair; and the second transmitting section transmits the rotation of the fourth gear rotated by the second drive motor rotating in the normal direction to the intermediate roller pair.

3. The image recording apparatus according to claim 2, wherein the intermediate roller pair is provided on a downstream side in the transporting direction of the first feeding roller and the second feeding roller, and on an upstream side in the transporting direction of the recording section.

4. The image recording apparatus according to claim 1, further comprising a control section controlling the first and second drive motors, and the recording section, wherein the control section controls the first and second drive motors to perform switching processing so that the second drive motor is intermittently rotated, under a condition that the first drive motor is driven to change the posture of the second gear.

5. The image recording apparatus according to claim 4, further comprising a detecting section which is provided on an upstream side of the intermediate roller pair in the transporting direction, which outputs a first output under a condition that the recording medium passes through the detecting section and which outputs a second output under a condition that the recording medium does not pass through the detecting section, wherein the control section drive the second drive motor after executing the switching processing, and then the control section inverts a direction of rotation of the second drive motor under a condition that the output of the detecting section is changed from the second output to the first output.

6. The image recording apparatus according to claim 5, further comprising a counter which counts a driving amount of the second drive motor; and a memory storing a predetermined amount, wherein the control section drives the second drive motor and at the same time, starts counting using the counter, and the control section stops the driving of the second drive motor, under a condition that an output of the detecting section at a time when an amount of counting of the counter reaches the predetermined amount is the second output.

7. The image recording apparatus according to claim 1, further comprising a control section which controls the first and second drive motors and the recording head, wherein the second gear is configured to change its posture further to a third posture by being moved in the moving direction by the carriage;

the drive transmission switching mechanism further includes:

a lever through which the supporting shaft is inserted, which is arranged alongside the second gear in the axial direction, which is configured to move in the axial direction, and which is pushed from a side of the second gear by the carriage;

a first elastic member which biases the lever toward the side of the second gear;

a second elastic member which biases the second gear toward a side of the lever with a force smaller than that of the first elastic member, and which is configured to move the lever and the second gear integrally in the axial direction of the supporting shaft, together with the first elastic member; and a holding member which holds the lever in the second posture changed from the first posture and in the first posture, and which releases the lever in the second posture changed from the third posture;

the drive transmission switching mechanism changes the posture of the second gear using the biasing force of the first elastic member from the third posture to the first posture via the second posture, under a condition that the carriage is separated from the lever; and the control section is configured to operate a plurality of operation modes including:

a standby mode in which the first drive motor is driven to change the posture of the second gear to the third posture to make the carriage to be kept on standby; and a high-speed printing mode in which the first drive motor is driven to change the posture of the second gear from the third posture to the first posture, the second drive motor is then driven to rotate the first feeding roller, which feeds the recording medium from the first mounting portion, the driving of the recording head is controlled to jet ink onto the fed recording medium, and at the same time, the second drive motor is driven to start feeding of the following recording medium mounted on the first mounting portion.

8. The image recording apparatus according to claim 7, further comprising a maintenance mechanism, wherein nozzles having jetting ports jetting ink are formed on the recording head;

the drive transmission switching mechanism further includes a fifth gear which engages with the second gear in the third posture and of which a rotation axis is directed in the axial direction; and the maintenance mechanism includes a cap of which posture is changable to a fourth posture covering the jetting ports of the nozzles and to a fifth posture separating from the jetting ports, and of which posture is changed from the fourth posture to the fifth posture by the fifth gear rotated by the second drive motor rotating in the normal direction.

9. The image recording apparatus according to claim 7, wherein the control section executes switching processing in which the second drive motor is intermittently rotated under a condition that the first drive motor is driven to change the posture of the second gear.

* * * * *